US009972936B2

(12) United States Patent
Matsumoto et al.

(10) Patent No.: US 9,972,936 B2
(45) Date of Patent: May 15, 2018

(54) CONNECTOR MEMBER AND CONNECTOR

(71) Applicant: J.S.T. Mfg. Co., Ltd., Osaka-shi, Osaka (JP)

(72) Inventors: Hiroyuki Matsumoto, Yokohama (JP); Koji Wada, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days. days.

(21) Appl. No.: 15/652,536

(22) Filed: Jul. 18, 2017

(65) Prior Publication Data

US 2018/0040976 A1 Feb. 8, 2018

(30) Foreign Application Priority Data

Aug. 5, 2016 (JP) ..... 2016-154921

(51) Int. Cl.
*H01R 13/627* (2006.01)
*H01R 13/641* (2006.01)

(52) U.S. Cl.
CPC ..... *H01R 13/6272* (2013.01); *H01R 13/6275* (2013.01); *H01R 13/641* (2013.01)

(58) Field of Classification Search
CPC ..... H01R 13/6272; H01R 4/4863
See application file for complete search history.

(56) References Cited

U.S. PATENT DOCUMENTS 5,820,399 A 10/1998 Shirouzu
6,644,996 B2 * 11/2003 Yamashita ..... H01R 13/641 439/352
9,666,989 B2 * 5/2017 Horiuchi ..... H01R 13/64
2007/0123080 A1 * 5/2007 Matsumoto ..... H01R 13/6273 439/164
2011/0207359 A1 * 8/2011 Matsumoto ..... H01R 13/6275 439/347
2016/0123361 A1 * 5/2016 Horiuchi ..... H01R 13/533 403/42

FOREIGN PATENT DOCUMENTS

JP H10-050408 A 2/1998

* cited by examiner

*Primary Examiner* — James Harvey
(74) *Attorney, Agent, or Firm* — Kratz, Quintos & Hanson, LLP

(57) ABSTRACT

Provided are a connector member and a connector that suppress a half-fitted condition of the connector, movement of a slide member with an external force, and release of fitting. In a connector, a first connector member including a first housing provided with a locking projection is fitted with a second connector member including a slide member having a locking part and a second housing. An elastic member is provided between the second housing and the slide member; the slide member includes a movable piece that has a pressed part and a locking part; movement of the first housing causes the pressed part to be pressed by the locking projection; and after movement of the slide member in fitting direction, the movable piece rotates, the pressed part is separated from the locking projection, the slide member moves with an elastic force, and the locking part engages with the locking projection.

6 Claims, 17 Drawing Sheets

102
104
106
108
110
112
114
116
118
120
122
124
126
128
130
132
134
136
138
140
142
144
146
148
150
152
154
156
158
160

162
168
204
190
186
188
180
176
194
164
178
172

162
172
210
202
164
218
176
184
190
194
180
184
212
216
174
182
210
218
178
214
166
216

162
164
174
178
198
220
226
168
176

162
168
224
176
218
172
194
174
164

162
184
172
180
190
194
188
186
184
196
206
192
200
178
208
174
206
196
206
200
176
168
170

CONNECTOR MEMBER AND CONNECTOR

BACKGROUND

Technical Field

The present invention relates to a connector member and a connector capable of preventing a half-fitted condition.

Related Art

JP H10-050408 A discloses an invention relating to a connector fitting construction in which a half-fitted condition can be prevented. The connector fitting construction disclosed in JP H10-050408 A includes a pair of male and female connectors that can be fitted and connected together, in which a half-fitted condition of the two connectors is prevented by a resilient force of a resilient member mounted in a housing of one of the two connectors, and there is provided a slide lock member that is slidably supported in the housing, and cooperates with the resilient member in fitting the one connector relative to the mating connector, to flex an elastic member provided on the housing and retain the elastic member on a mating housing. In the connector fitting construction, a receiving portion that receives the slide lock member therein is formed by an exclusive-use housing other than a connector housing having terminal receiving chambers; and side spaces are provided in the receiving portion, and are disposed respectively on opposite sides of the elastic member; and abutment projections, formed respectively on opposite side portions of a lower surface of an elastic arm provided on the slide lock member, are disposed respectively in the side spaces.

SUMMARY

In the connector fitting construction disclosed in JP H10-050408 A, since the both connectors are locked with assistance of a slider having a resilient force of the resilient member after fitting, the slider is easily moved by an external force, and there is a risk that the fitting may be released.

Accordingly, an object of the present invention is to provide a connector member and a connector that suppress a half-fitted condition of the connector, movement of a slide member due to an external force, and release of fitting.

To achieve the object above, a connector member according to a first aspect of the present invention includes: a slide member having a locking part to be engaged with a locking projection provided on an outer circumference of a counterpart connector member; and a housing provided inside the slide member. The connector member is configured such that:

the slide member is capable of repeatedly moving in a fitting direction with respect to the housing;

at least one elastic member is provided between the housing and the slide member;

the slide member is provided with a movable piece that is connected by a shaft part and rotatable about the shaft part as an axis, in a direction orthogonal to a moving direction of the slide member;

the movable piece has a pressed part that is pressed toward fitting-direction side of the locking projection, and the locking part to be engaged to a side opposite to the fitting-direction side of the locking projection;

when the connector member is fitted with the counterpart connector member, movement of the counterpart connector member in the fitting direction causes the pressed part of the movable piece to be pressed by the locking projection, so that the slide member is moved to the fitting direction while compressing the elastic member, and the connector member and the counterpart connector member are put in a fitting condition; and after that, rotation of the movable piece about the shaft part as the axis causes the pressed part to be separated from the locking projection, and an elastic force of the elastic member causes movement of the slide member in a direction opposite to the moving direction, and engagement of the locking part of the movable piece to the locking projection.

In a connector according to a second aspect of the present invention, a first connector member having a first housing provided with a locking projection on an outer circumference is fitted with a second connector member having a slide member that has a locking part to be engaged with the locking projection, and a second housing provided inside the slide member. The connector is configured such that:

the slide member is capable of repeatedly moving in a fitting direction with respect to the second housing;

at least one elastic member is provided between the second housing and the slide member;

the slide member is provided with a movable piece that is connected by a shaft part and rotatable about the shaft part as an axis, in a direction orthogonal to a moving direction of the slide member;

the movable piece has a pressed part that is pressed toward fitting-direction side of the locking projection, and the locking part to be engaged to a side opposite to the fitting-direction side of the locking projection;

when the first connector member is fitted with the second connector member, movement of the first housing in the fitting direction causes the pressed part of the movable piece to be pressed by the locking projection of the first housing, so that the slide member is moved to the fitting direction while compressing the elastic member, and the first connector member and the second connector member are put in a fitting condition; and after that, rotation of the movable piece about the shaft part as the axis causes the pressed part to be separated from the locking projection, and an elastic force of the elastic member causes movement of the slide member in a direction opposite to the moving direction, and engagement of the locking part of the movable piece to the locking projection.

A connector according to a third aspect of the present invention is configured such that, in the connector of the second aspect, there is provided a pressing projection that presses an opposite side to the pressed part across the shaft part of the movable piece, of the second housing, that is fitted with the first housing, to cause rotation about the shaft part as an axis; and the movable piece of the moved slide member is rotated by pressing with the pressing projection.

A connector according to a fourth aspect of the present invention is configured such that, in the connector of the third aspect, on a side of the second housing opposite to a side to be fitted with the first housing, there is formed a fitting part into which the movable piece pressed by the pressing projection is fitted.

A connector according to a fifth aspect of the present invention is configured such that, in the connector of the second aspect, an operation part is formed on a side opposite to the pressed part across the shaft part of the movable piece; and rotating the movable piece by pressing the operation part causes disengagement between the locking projection of the second housing and a locking part of the movable piece.

A connector according to a sixth aspect of the present invention is configured such that, in the connector of the second aspect, the slide member is formed into a cylindrical shape to surround the second housing;

the movable piece is provided on a surface that surrounds the second housing of the slide member; and a covering part that covers the movable piece is provided on the surface of the slide member provided with the movable piece.

According to the connector member of the first aspect of the present invention, since the locking projection is not engaged with the locking part of the slide member when the connector member is not fitted with the counterpart connector member, the elastic force of the elastic member pushes back the first connector member, enabling prevention of a half-fitted condition. Additionally, the locking projection and the locking part of the slide member are mechanically engaged, and the elastic force of the elastic member is not exerted, suppressing movement of the slide member due to an external force, and detachment of the fitting.

According to the connector of the second aspect of the present invention, since the locking projection of the first housing is not engaged with the locking part of the slide member when the first connector member is not fitted with the second connector member, the elastic force of the elastic member pushes back the first connector member, enabling prevention of a half-fitted condition. Additionally, the locking projection of the first housing and the locking part of the slide member are mechanically engaged, and the elastic force of the elastic member is not exerted, suppressing movement of the slide member due to an external force, and detachment of the fitting.

According to the connector of the third aspect of the present invention, moving the second connector member to a fitting position causes the second connector member to come into contact with the slide member, and the movable piece to be rotated, enabling easy engagement.

According to the connector of the fourth aspect of the present invention, guiding the movable piece rotated in response to the movement of the slide member to the fitting part enables smooth rotation of the movable piece.

According to the connector of the fifth aspect of the present invention, pressing the operation part causes disengagement, enabling easy detachment of the first connector member and the second connector member.

According to the connector of the sixth aspect of the present invention, the covering part is formed on a surface of the slide member provided with the movable piece, which can protect the movable piece and prevent reduction in strength on the surface formed with the movable piece, of the slide member.

DETAILED DESCRIPTION

An embodiment of the present invention is described below with reference to drawings. However, the following embodiment is illustrative of a connector member and a connector to embody a technical idea of the present invention, which is not meant to be limiting the present invention on these and can be equally applied to those of other embodiments included in the appended claims.

Embodiment

Figure 1A:
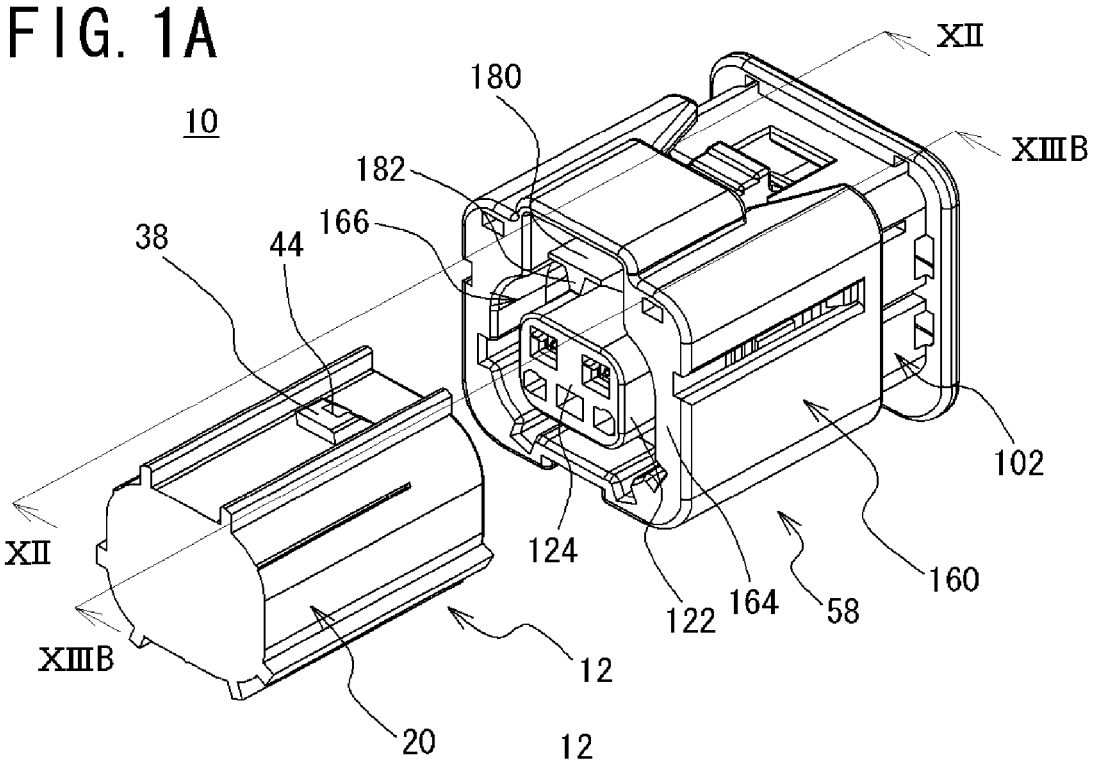
FIG. 1A is a perspective view illustrating a state before fitting of a first connector member and a second connector member that configure a connector according to an embodiment as viewed from one side.
Figure 1B:
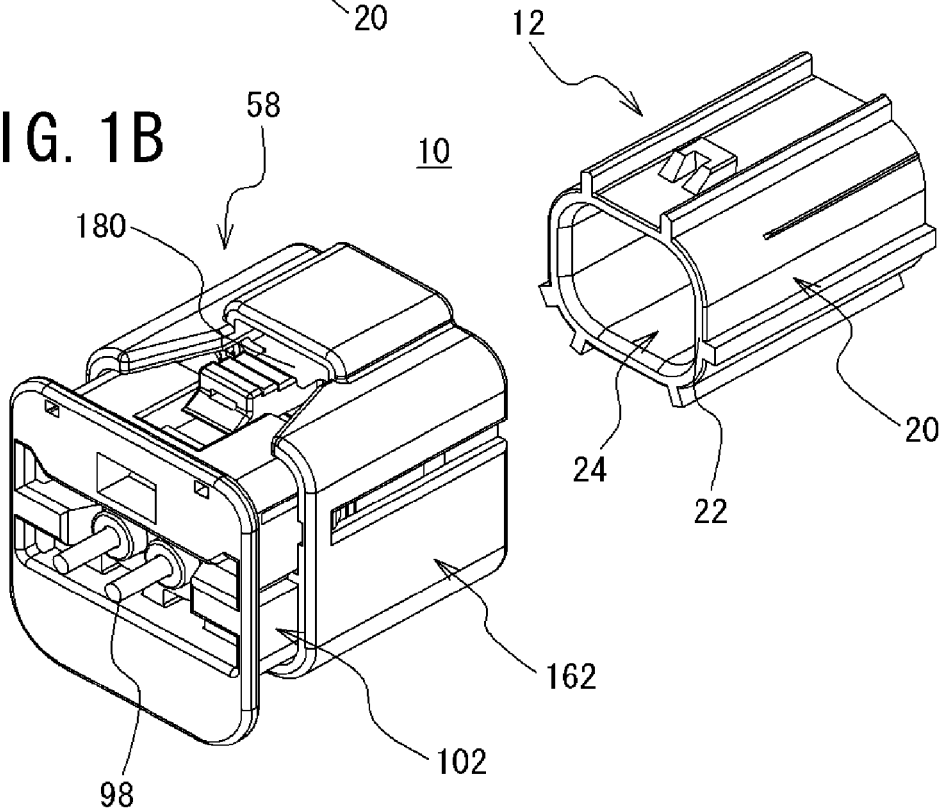
FIG. 1B is a perspective view as viewed from another side.
Figure 2:
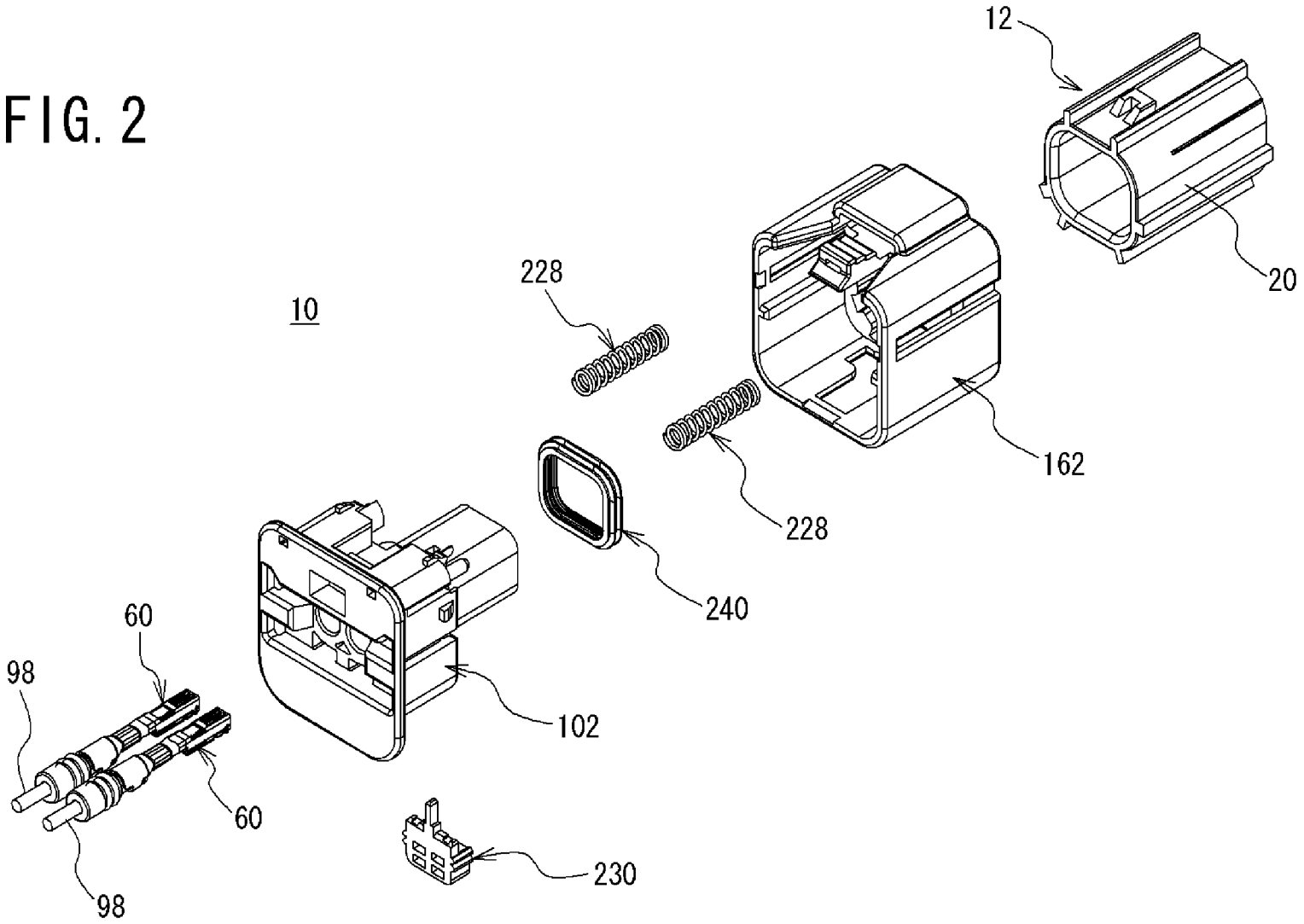
FIG. 2 is an exploded perspective view of the connector according to the embodiment.
Figure 3A:
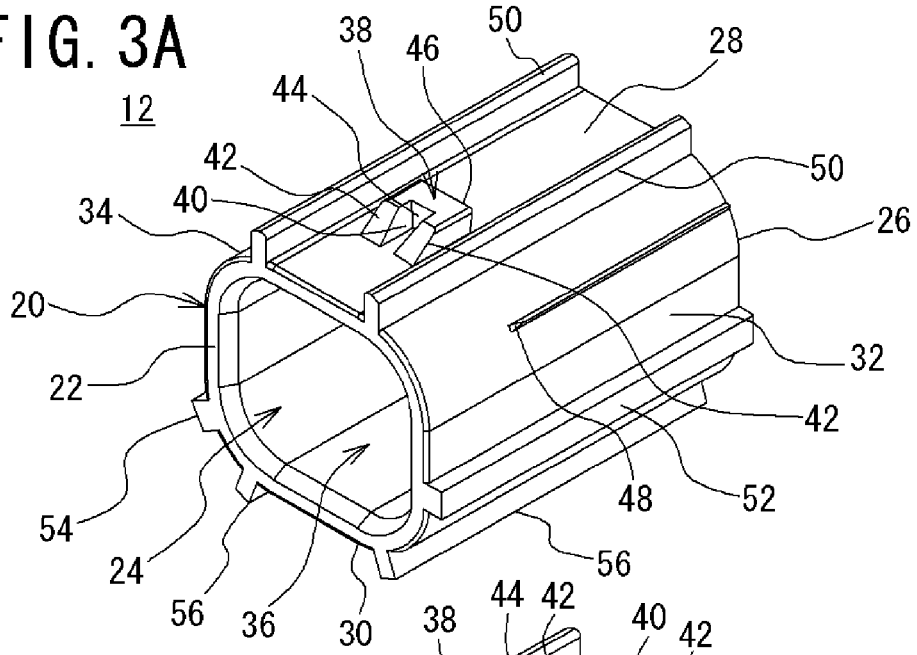
FIG. 3A is a perspective view of the first connector member as viewed from one side.
Figure 3B:
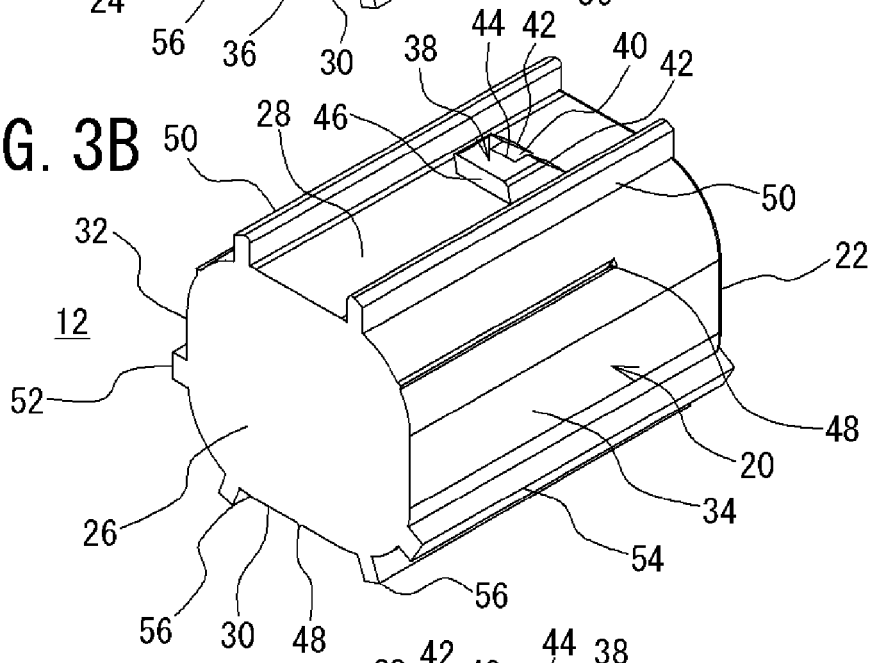
FIG. 3B is a perspective view as viewed from another side.
Figure 3C:
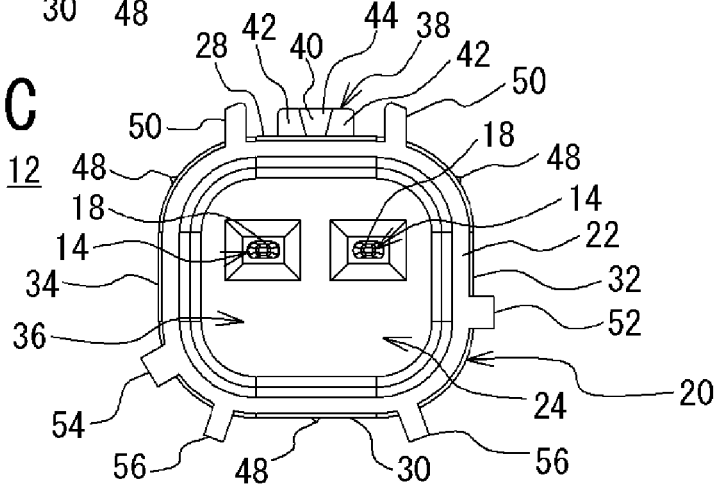
FIG. 3C is a front view.
Figure 4A:
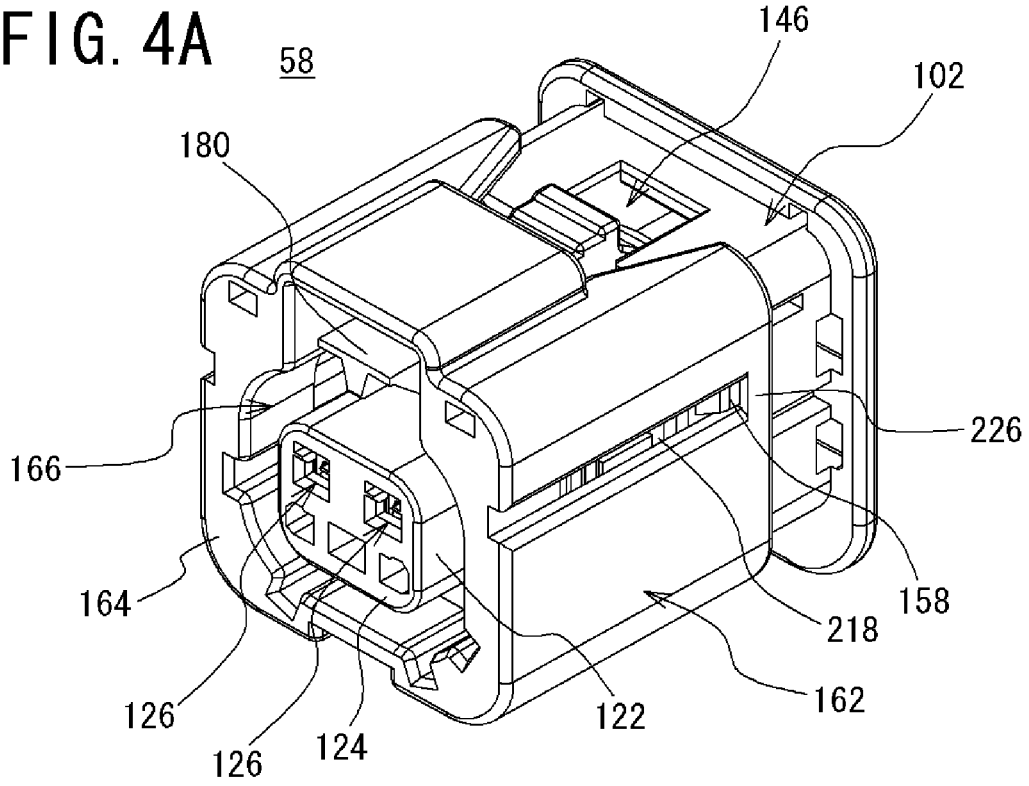
FIG. 4A is a perspective view of the second connector member as viewed from one side.
Figure 4B:
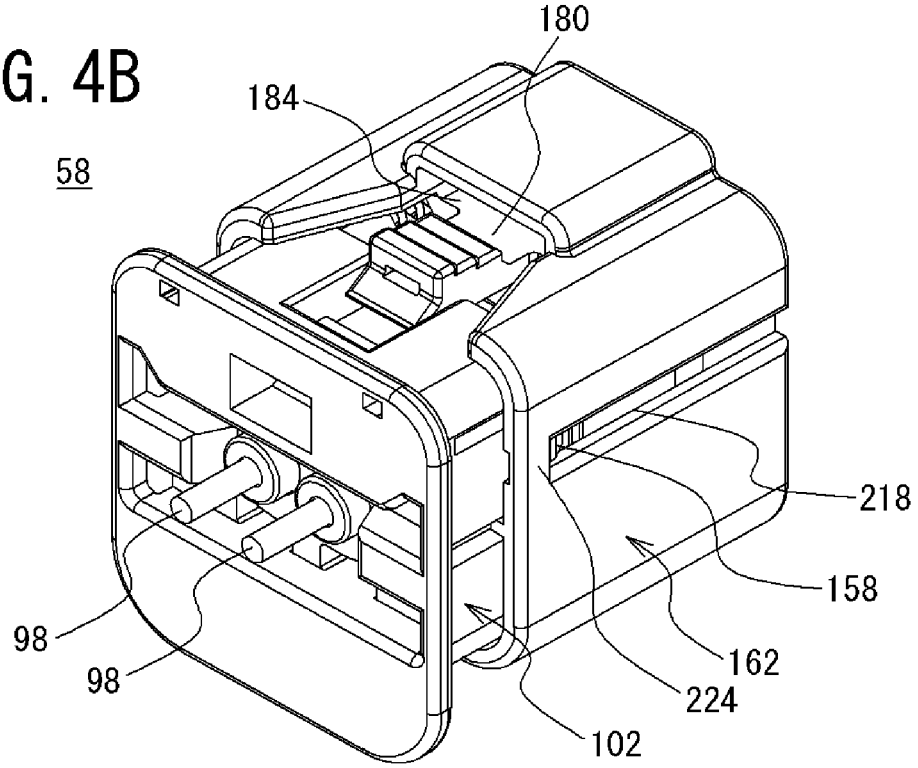
FIG. 4B is a perspective view as viewed from another side.
Figure 5A:
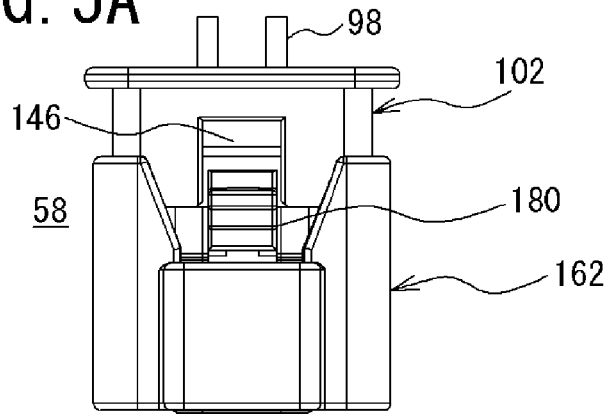
FIG. 5A is a plan view of the second connector member.
Figure 5B:
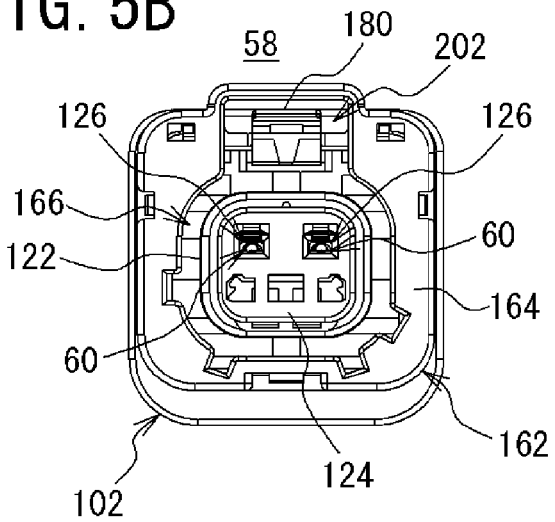
FIG. 5B is a front view.
Figure 5D:
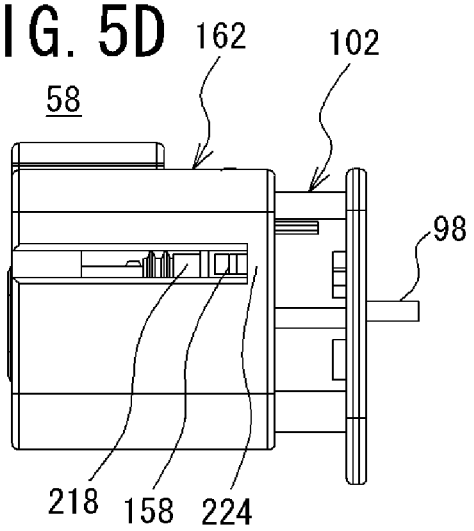
FIG. 5D is a side view as viewed from one side.
Figure 5C:
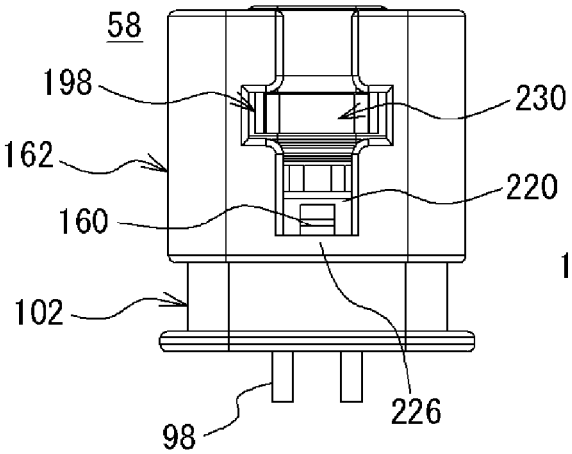
FIG. 5C is a bottom view.
Figure 5E:
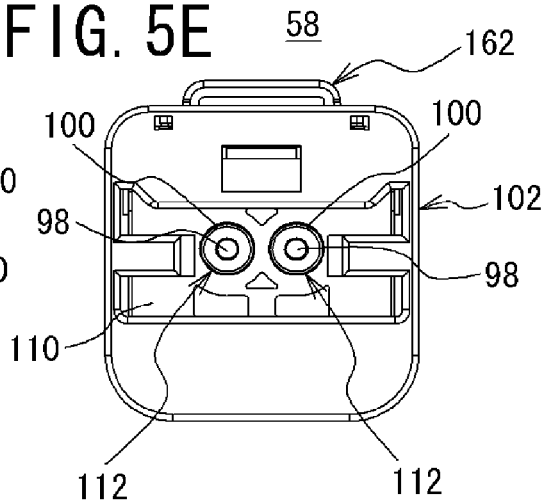
FIG. 5E is a rear view.
Figure 6A:
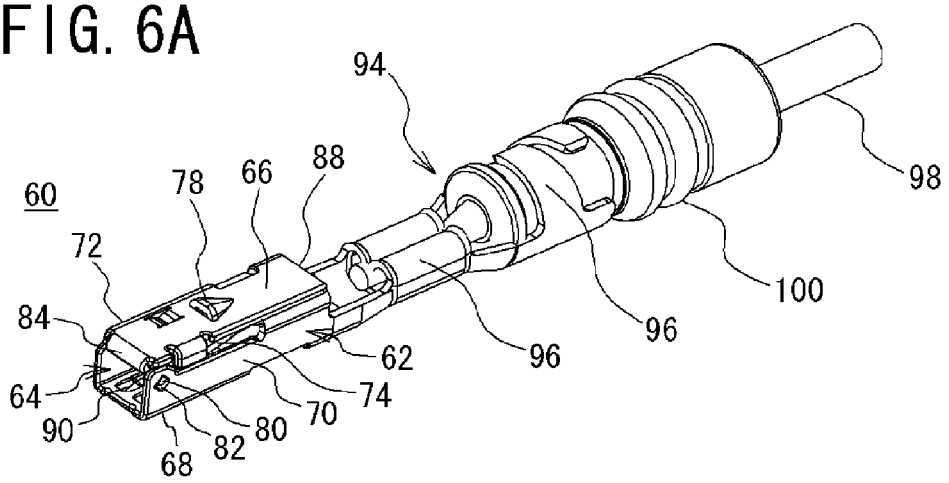
FIG. 6A is a perspective view of a second contact in a state being mounted with a wire.
Figure 6B:
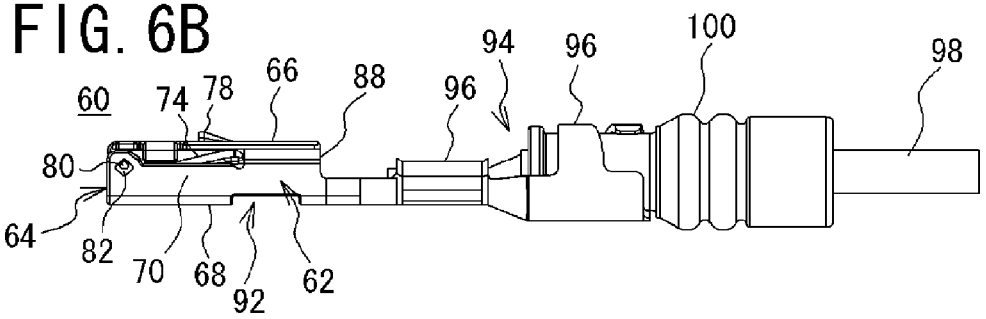
FIG. 6B is a side view as viewed from one side.
Figure 6C:
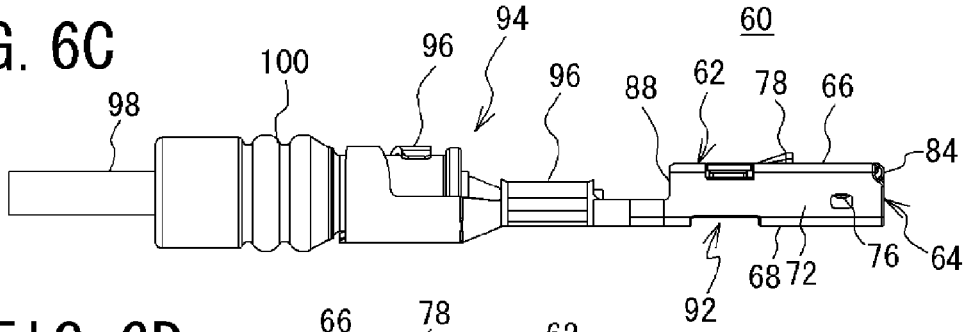
FIG. 6C is a side view as viewed from another side.
Figure 6D:
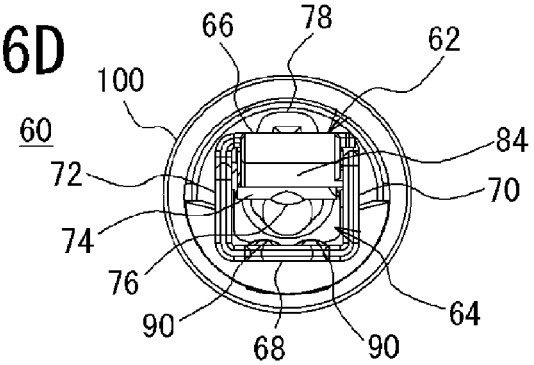
FIG. 6D is a front view.
Figure 7A:
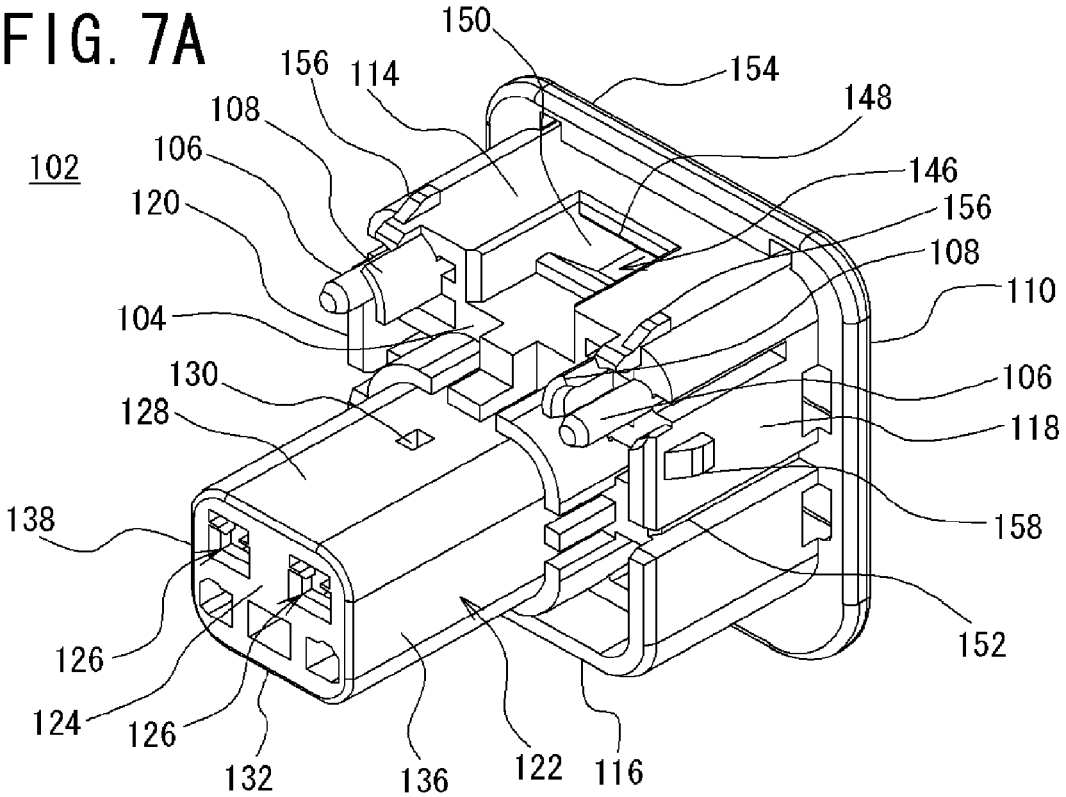
FIG. 7A is a perspective view of the second housing as viewed from one side.
Figure 7B:
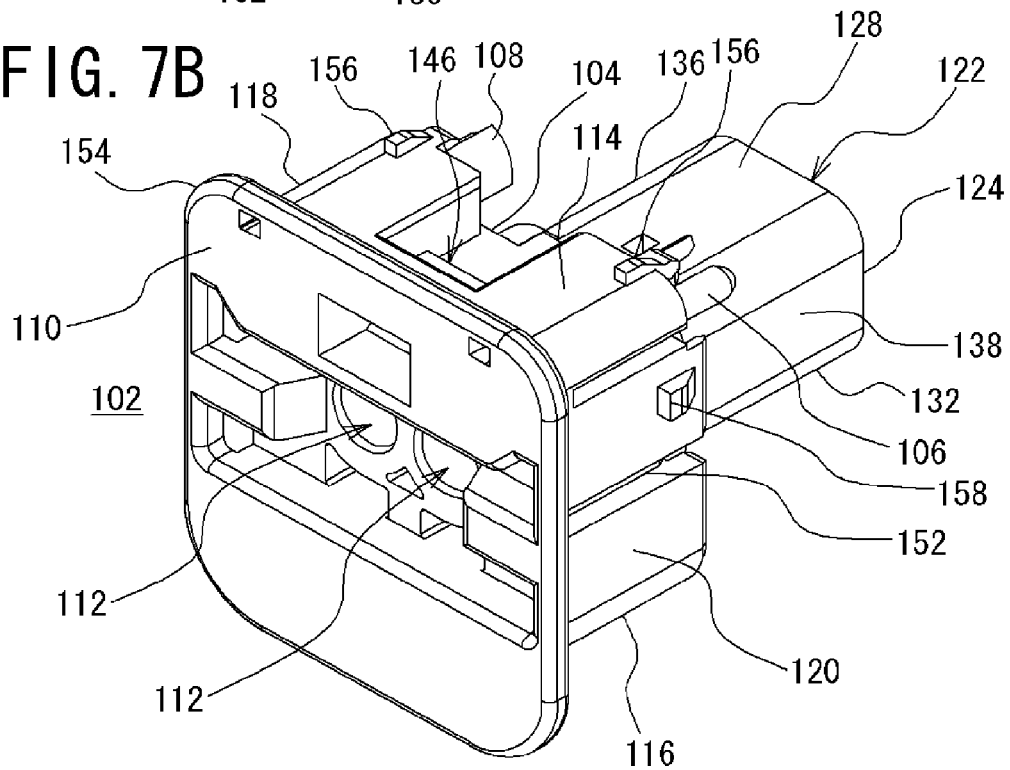
FIG. 7B is a perspective view as viewed from another side.
Figures 8A, 8B, 8C, 8D, 8E:
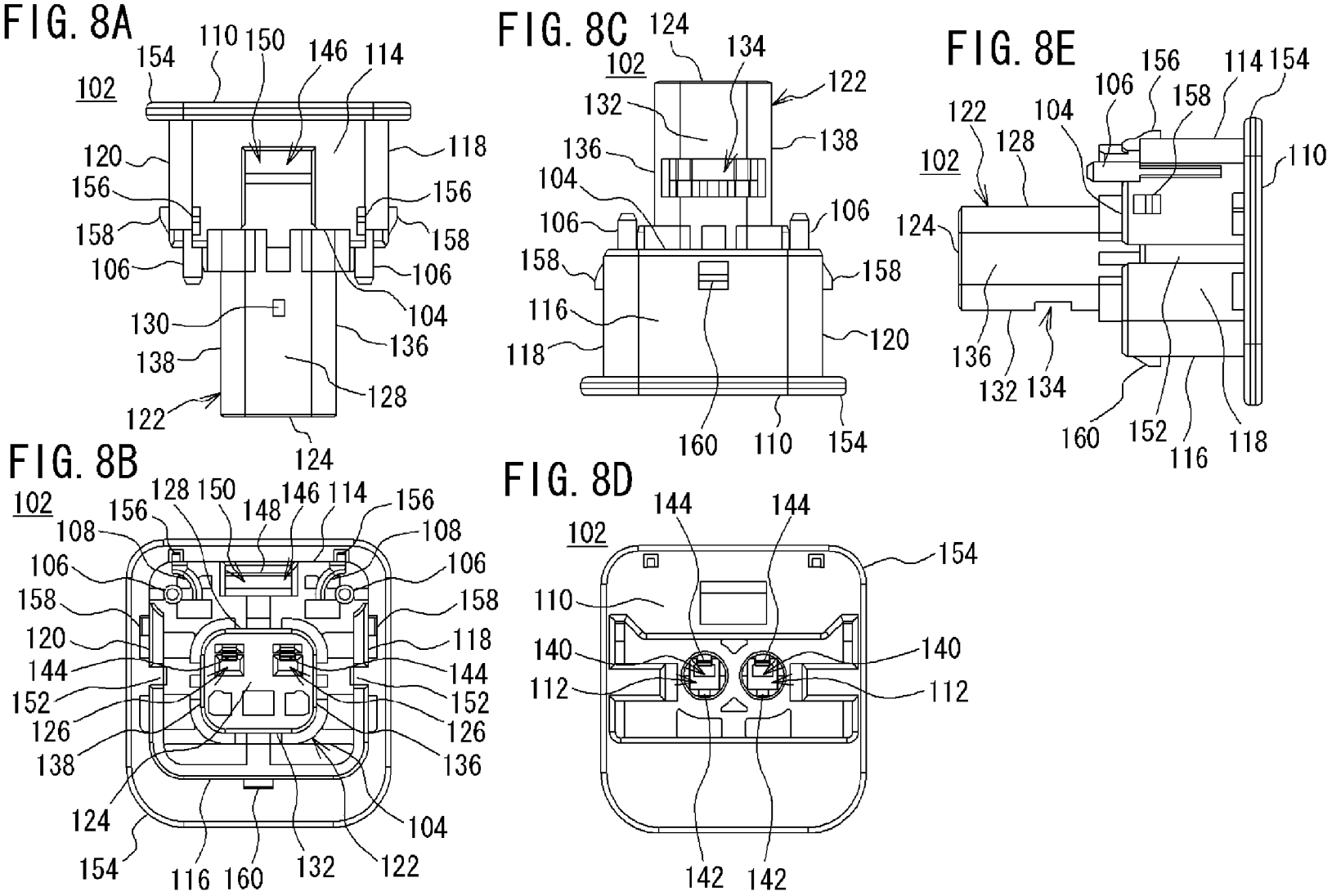
FIG. 8A is a plan view of the second housing.
FIG. 8B is a front view.
FIG. 8C is a bottom view.
FIG. 8D is a rear view.
FIG. 8E is a side view as viewed from one side.
Figure 9A:
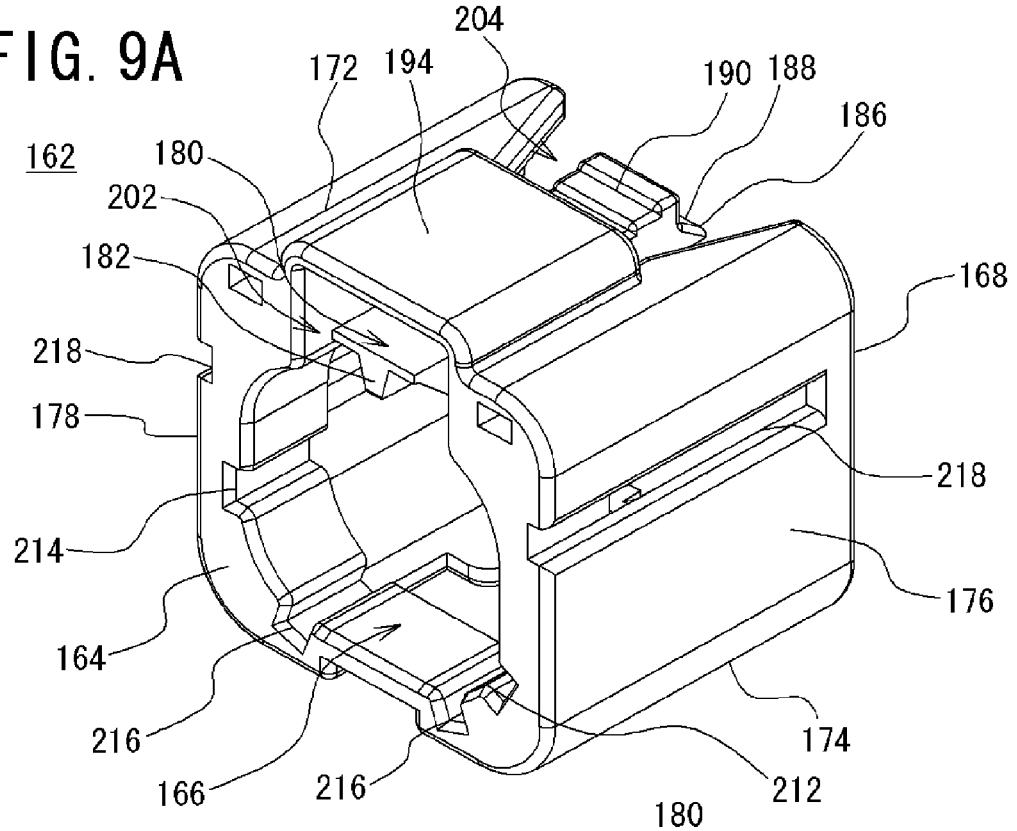
FIG. 9A is a perspective view of a slide member as viewed from one side.
Figure 9B:
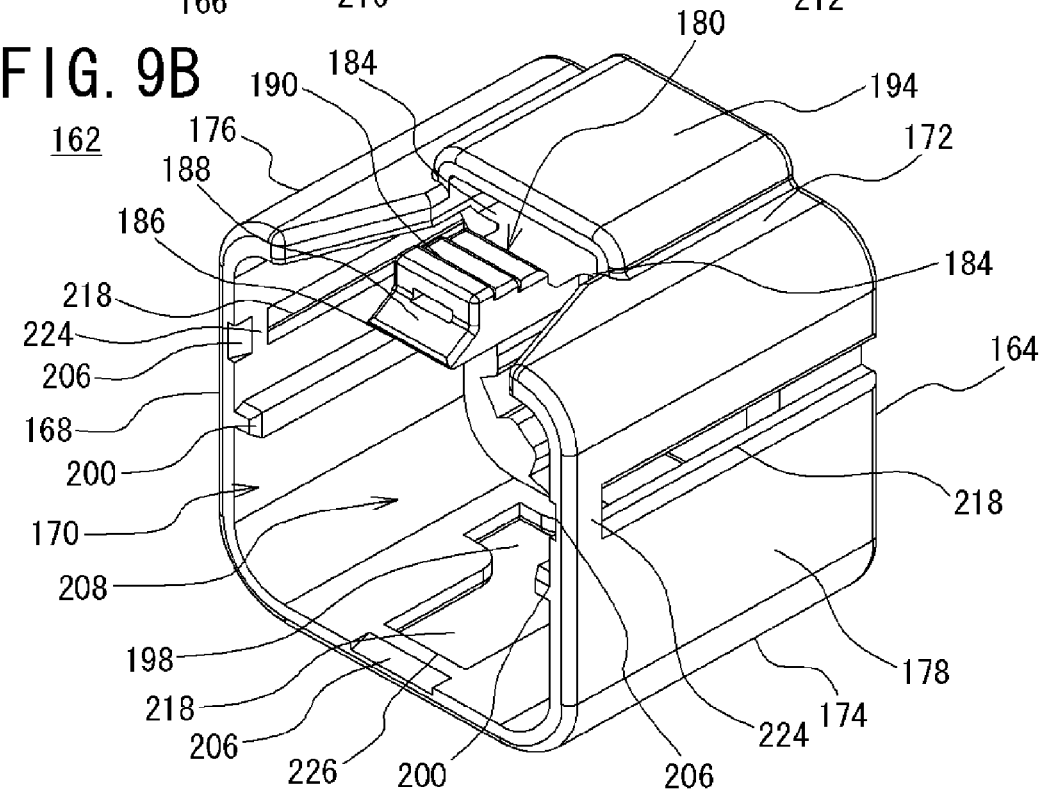
FIG. 9B is a perspective view as viewed from another side.
Figures 10A, 10B, 10C, 10D, 10E:
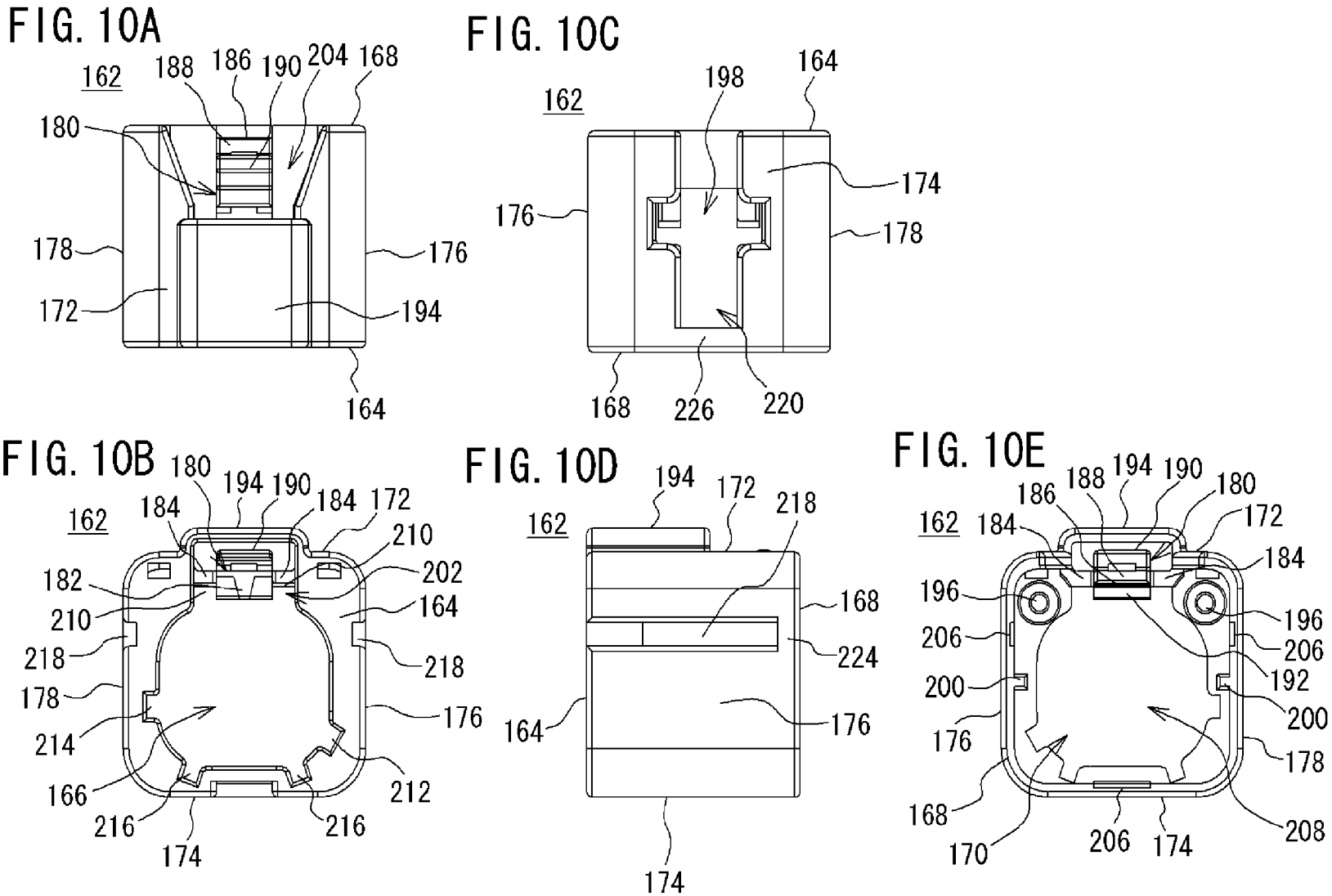
FIG. 10A is a plan view of the slide member.
FIG. 10B is a front view.
FIG. 10C is a bottom view.
FIG. 10D is a side view as viewed from one side.
FIG. 10E is a rear view.

A connector 10 according to an embodiment of the present invention is described with reference to FIGS. 1A to 17. As illustrated in FIGS. 1A to 2, the connector 10 of the embodiment is configured by a first connector member 12 having a first contact 14, and a second connector member 58 as a connector member having a second contact 60 to be contacted with the first contact 14. In the connector 10, fitting of the first connector member 12 and the second connector member 58 causes contact between the first contact 14 provided in the first connector member 12, and the second contact 60 provided in the second connector member 58, causing electrical connection.

In the second connector member 58 of the embodiment, there are provided a coiled spring member 228 as an elastic member, and a slide member 162 that is moved by an elastic force of this spring member 228. The slide member 162 is formed with a locking part 192 that is engaged with a locking projection 38 formed on the first connector member 12 (see FIG. 12), and when the first connector member 12 is inserted into the second connector member 58, the slide member 162 of the second connector member 58 is engaged with the first connector member 12, enabling fitting of the first connector member 12 and the second connector member (see FIGS. 16A and 16B).

When the slide member 162 of the second connector member 58 is not engaged to the first connector member 12, an operator can see that the first connector member and the second connector member are not fitted since the spring member 228 pushes back the slide member 162 to an original position, enabling prevention of a half-fitted condition.

First, the first connector member 12 is described with reference to FIGS. 3A to 3C, and 12. The first connector member 12 is configured by at least one first contact 14, which is two first contacts 14 in the embodiment, and a first housing 20 containing the first contact 14 inside.

The first contact 14 has a first contact body 16, and has a first contact part 18, on one side of this first contact body 16, that is contacted with the second contact 60 of the second connector member 58. The first contact 14 is, for example, formed by bending or the like of a metal rod. Although not shown, another side of the first contact 14 may be configured, for example, as a connection part that is connected to a substrate or the like, or to be connected to a wire.

Next, the first housing 20 is described with reference to FIGS. 3A to 3C, and 12. The first housing 20 is configured by: a first front surface 22 formed with a first opening 24 that is inserted with a part of the second housing 102 of the second connector member 58; a first rear surface 26 that is opposed to the first front surface 22 and closed; a first upper surface 28 to surround an outer circumference; a first bottom surface 30; a one first-side-surface 32; and an another first-side-surface 34. The first housing 20 is a cylindrical body having a predetermined length, and is integrally formed by a resin material.

Inside of the first housing 20, which is surrounded by the first upper surface 28, the first bottom surface 30, the one first-side-surface 32, and the another first-side-surface 34, is provided with a space part 36 that is coupled to the first opening 24 of the first front surface 22. In this space part 36, the second housing 102 is to be inserted, and the first contact part 18 of the first contact 14 is to be disposed. On the outer circumference of the first housing 20, a plurality of guide parts 50, 52, 54, and 56 described later are formed along a direction of fitting to the second connector member 58. In the embodiment, two of the plurality of guide parts 50, 52, 54, and 56 are formed on the first upper surface 28, two of them on the first bottom surface 30, and one of them on each of the one first-side-surface 32 and the another first-side-surface 34. The second connector member 58 is to be inserted into the first front surface 22 side of the first housing 20.

The first front surface 22 of the first housing 20 is formed with the first opening 24 that is to be inserted with the second housing 102. An inner circumference side of the first front surface 22 is slantly tapered, to achieve easy insertion of the second housing 102. An outer circumference side of the first front surface 22 is formed with a plurality of projections that form the plurality of guide parts 50, 52, 54, and 56 formed on the outer circumference side of the first housing 20.

The first rear surface 26 of the first housing 20 is closed to have a wall-like shape. In the embodiment, although not shown, there can be formed a connection part from this first rear surface 26 side to the first contact 14, or an opening passed with a wire or the like mounted to the first contact 14. An outer circumference side of the first rear surface 26 is formed with a plurality of projections that form the plurality of guide parts 50, 52, 54, and 56.

On the first upper surface 28 of the first housing 20, the locking projection 38 is formed. This locking projection 38 is a part to be engaged with a locking part 192 formed in the slide member 162 of the second connector member 58 described later. The locking projection 38 is formed on an axis of the fitting direction of the first upper surface 28 of the first housing 20, on the first front surface 22 side with respect to a center portion. The first front surface 22 side of the locking projection 38 is formed into a U shape in plan view, while being configured by a concave portion 40 with a center portion recessed, and a pair of protrusions 42 that protrude on both sides of this concave portion 40 toward the first front surface 22 side. The pair of protrusions 42 of the locking projection 38 are slantly formed so as to have an acute angle on the fitting direction side. A depth side of the concave portion 40 of the locking projection 38 has a shape that is slightly slanted to the first rear surface 26 side from substantially vertical with respect to the first upper surface 28, and is configured as a pressing part 44 formed into a shape capable of pressing the slide member 162 of the second connector member 58.

On the other hand, the first rear surface 26 side of the locking projection 38 is configured as a locking surface 46 that is to be engaged with the locking part 192 of the slide member 162. The locking surface 46 is formed to be slightly slanted toward the first rear surface 26 side from substantially vertical with respect to the first upper surface 28. The locking part 192 is caught by this slantly formed locking surface 46.

On the first upper surface 28, an upper-surface guide part 50 is formed along the fitting direction on each of the one first-side-surface 32 side and the another first-side-surface 34 side. This upper-surface guide part 50 formed on the first upper surface 28 is formed to protrude substantially vertically with respect to the first upper surface 28.

On the first bottom surface 30, a bottom-surface guide part 56 is formed along the fitting direction on each of the one first-side-surface 32 side and the another first-side-surface 34 side. This bottom-surface guide part 56 is formed to slantly protrude from the first bottom surface 30 toward each of the one first-side-surface 32 side and the another first-side-surface 34 side.

On the one first-side-surface 32, a one side-surface guide part 52 is formed along the fitting direction. This one side-surface guide part 52 is formed to protrude from the one first-side-surface 32 in a substantially vertical direction.

On the another first-side-surface 34, an another side-surface guide part 54 is formed along the fitting direction.

This another side-surface guide part 54 is formed to slantly protrude toward the first bottom surface 30 side from the another first-side-surface 34 side. Note that, the upper-surface guide part 50, the bottom-surface guide part 56, the one side-surface guide part 52, and the another side-surface guide part 54 may collectively be referred to as each of the guide parts 50, 52, 54, and 56.

On each of the first bottom surface 30, the one first-side-surface 32, and the another first-side-surface 34, a pressing projection 48 protruding along the fitting direction is formed. This pressing projection 48 is to be a portion of a part that presses the slide member 162 in fitting with the second connector member 58.

Inside the first housing 20, the first contact part 18 of the first contact 14 protrudes from the first rear surface 26 side, and is to be contacted with the second contact 60 of the inserted second connector member 58. The portion where the first contact part 18 of the first contact 14 protrudes is formed to be partially raised, to hold the first contact 14.

Into the space part 36 inside the first housing 20, the second housing 102 is inserted, and a seal member 240 mounted on an outer circumference of the second housing 102 is also inserted. The seal member 240 adheres the inner circumference side of the space part 36, namely, inside of the first upper surface 28, the first bottom surface 30, the one first-side-surface 32, and the another first-side-surface 34, to provide waterproofness.

The first housing 20 and the first contact 14 may be integrally formed by molding or the like, or may be formed into separate bodies and assembled.

Next, the second connector member 58 is described with reference to FIGS. 2, and 4A to 12. As illustrated in FIGS. 2, 4A to 5E, and 12, the second connector member 58 includes: at least one second contact 60, which is two second contacts 60 in the embodiment, that is mounted with a wire 98; the second housing 102 that contains the second contact 60; the slide member 162 that is attached repeatedly movably with respect to the second housing 102; and at least one coiled spring member 228, which is two coiled spring members 228 as the elastic member in the embodiment, that is provided between the second housing 102 and the slide member 162.

The second connector member 58 is also provided with a retainer 230 that is attached to the second housing 102 and positions and fixes the second contacts 60 at a predetermined position in the second housing 102. Additionally, the annular seal member 240 is attached to the portion, of the second housing 102, that is to be inserted into the space part 36 of the first housing 20.

First, the second contact 60 is described with reference to FIGS. 2, and 5A to 6D. While two second contacts 60 are provided in this embodiment, one second contact 60 is described as a representative, since individual second contacts 60 are common.

The second contact 60 has a second contact body 62, an insertion port 64 that is inserted with the first contact part 18 of the first contact 14, on one side of this second contact body 62, and a wire mounting part 94 that is mounted with the wire 98 on another side of the second contact body 62. The second contact 60 is formed by punching a metal plate and bending or the like. Inside the second contact body 62 is provided with a second contact part 76 that is contacted with the first contact part 18 of the first contact 14.

The second contact body 62 is formed with the insertion port 64 that is inserted with the first contact part 18 of the first contact 14, on one side, and cylindrically formed and surrounded by an upper surface portion 66, a bottom surface portion 68, a one side-surface portion 70, and an another side-surface portion 72.

The upper surface portion 66 of the second contact body 62 is formed with a convex portion 78 having a substantially center portion protruding outwardly. This convex portion 78 is a part to be passed with a concave portion 142 formed in an contact insertion port 112 of the second housing 102 when being inserted into the second housing 102, which is to guide the insertion of the second contact 60. Since the convex portion 78 is formed on the second contact body 62, the second contact 60 can be prevented from being inserted in a different direction.

On the wire mounting part 94 side of the upper surface portion 66 of the second contact body 62, there is provided a fixing part 88 into which a fixing projection 236 of the retainer 230, described later, is fitted to be positioned and fixed.

From the fixing part 88 side of the upper surface portion 66 of the second contact 60, a contact piece 74 formed with the second contact part 76 is extended toward inside the second contact body 62. This contact piece 74 is configured to be elasticity deformed about the fixing part 88 side of the upper surface portion 66 as an axis. Whereas, from an end part on the insertion port 64 side of the upper surface portion 66 of the second contact 60, there is extended a contact-piece protection part 84 that protects a tip of the extended contact piece 74, toward inside the second contact body 62.

The one side-surface portion 70 side of the contact-piece protection part 84 is formed with a projection part 80 that is fitted into a hole part 82 formed on the one side-surface portion 70. Fitting of this projection part 80 into the hole part 82 causes the contact-piece protection part 84 to be fixed.

On the bottom surface portion 68 side of a part that is elasticity deformed in the contact piece 74, the second contact part 76 is formed to protrude, and this second contact part 76 is to be contacted with the first contact part 18 of the first contact 14.

On the bottom surface portion 68 of the second contact body 62, an opened fitting port 92 is formed. When a claw-shaped lance 144 provided in a contact container 140 formed in the second housing 102 described later (see FIGS. 8B and 8D) enters into this fitting port 92, the second contact 60 is positioned and fixed in the contact container 140.

A pair of recesses are formed toward inside from the bottom surface portion 68 of the second contact body 62, and a pair of raised portions 90 are formed to protrude in the second contact body 62, inside of a portion formed with these recesses. These raised portions 90 are formed at a portion opposed to the second contact part 76, and are to press the inserted first contact 14 toward the second contact part 76 side.

The one side-surface portion 70 of the second contact body 62 is formed with the hole part 82 that is fitted with a projection part 80 formed on the contact-piece protection part 84 described above.

The wire mounting part 94 has a plurality of mounting pieces 96 that are connected when mounted with the wire 98. Then, folding of these mounting pieces 96 causes the wire 98 to be mounted to the second contact 60. Some of the mounting pieces 96 are mounted to a conductive electric wire portion of the wire, and some are mounted to an insulating resin portion that covers the electric wire.

In the embodiment, the wire 98 on the wire mounting part 94 side is provided with a seal part 100, for example, formed by a resin material. When this seal part 100 is contained in the contact container 140, which is formed in the second housing 102 described later and inserted with the second contact 60 to contain the second contact 60, the seal part 100 adheres inside the contact container 140 to allow the second contact 60 to be stably contained, and to provide waterproofness. This seal part 100 may be integrally formed with a wire, and may be formed as a separate member and assembled.

Next, the second housing 102 is described with reference to FIGS. 2, 7A to 8E, and 12. The second housing 102 is configured by: a second front surface 104 formed with a protruded insertion part 122 that is formed with an insertion opening 126 into which the first contact 14 of the first connector member 12 is inserted; a second rear surface 110 that is on an opposite side to the second front surface 104 and formed with the contact insertion port 112 into which the second contact 60 is inserted; and the second upper surface 114, a second bottom surface 116, a one second-side-surface 118, and an another second-side-surface 120. The second housing 102 is integrally formed by a resin material.

Inside the second housing 102, through the insertion part 122, there is formed the contact container 140 that contains each of the second contacts 60, and the insertion opening 126 formed on a front part 124 on a tip side of the insertion part 122 is coupled to the contact insertion port 112 formed on the second rear surface 110.

The second front surface 104 of the second housing 102 is formed with the insertion part 122 that protrudes from a substantially center portion in a direction of fitting to the first connector member 12. This insertion part 122 is a part to be inserted from the first opening 24 formed on the first housing 20 and disposed in the space part 36 inside, in fitting with the first connector member 12. At this time, the first contact 14 of the first connector member 12 is to be inserted from the first opening 24 formed on the second front surface 104, and to be contacted with the second contact 60 contained in the contact container 140.

The insertion part 122 is formed into a substantially rectangular prism shape having a predetermined length, and the front part 124 is formed with the insertion opening 126 into which the first contact 14 is inserted. An outer circumference of the insertion part 122 is surrounded by an upper part 128, a bottom part 132, a one side-part 136, and an another side-part 138, and each corner is formed into a curved surface shape.

The bottom part 132 of the insertion part 122 is formed with a retainer mounting part 134 that is inserted and mounted with the retainer 230 described later. The upper part 128 of the insertion part 122 is formed with a retainer-projecting port 130 through which a tip side of a supporting part 238 of the mounted retainer 230 (see FIGS. 11A to 12) is projected.

Figure 12:
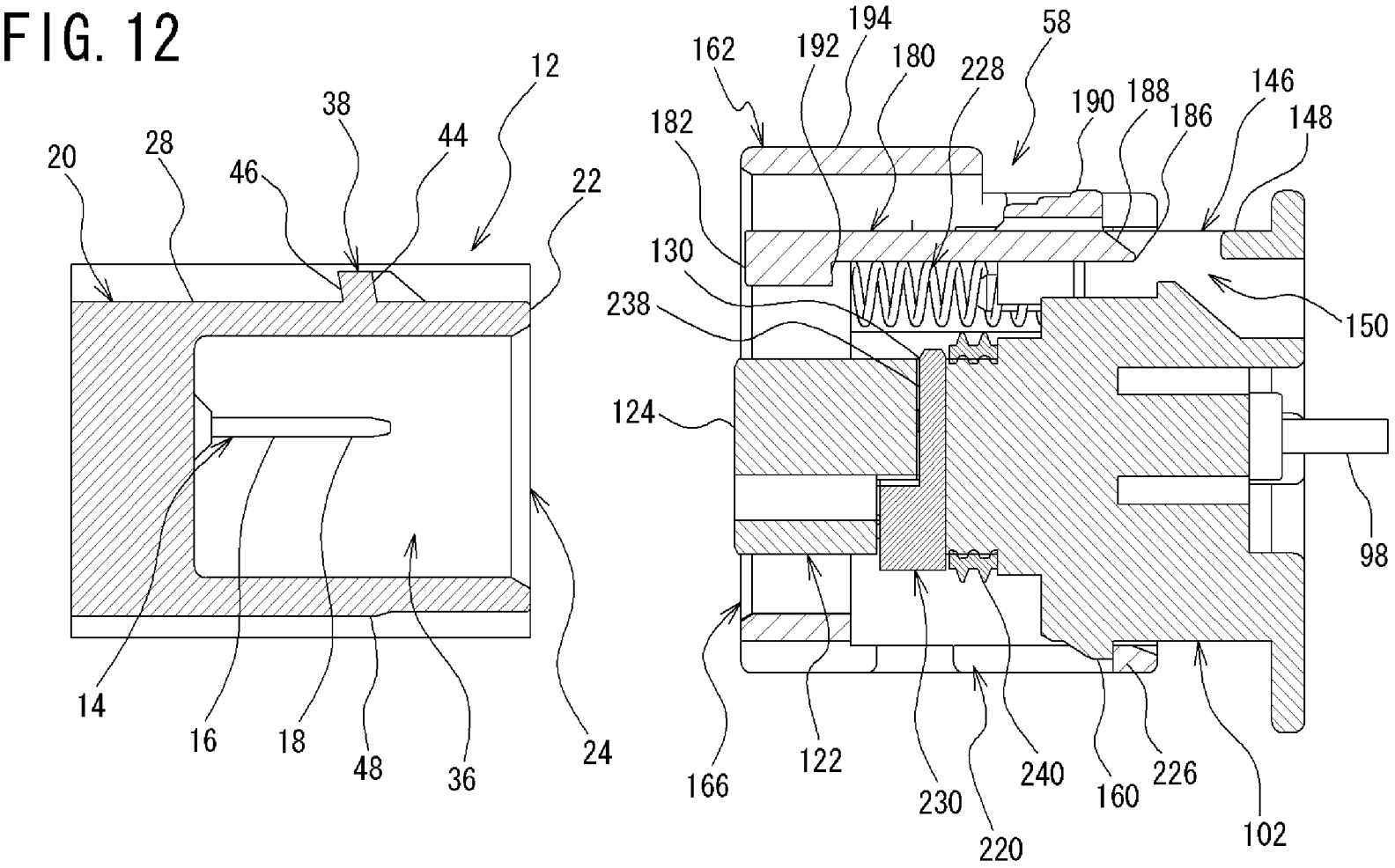
FIG. 12 is a cross-sectional view of XII-XII line in FIG. 1A.

An outer circumference of the second front surface 104 side of the insertion part 122 is to be mounted with the annular seal member 240 (see FIGS. 2 and 12).

On the second front surface 104, a pair of rod-shaped one spring-support parts 106 each are formed to protrude toward the one second-side-surface 118 side and the another second-side-surface 120 side, on the second upper surface 114 side. These one spring-support parts 106 are parts to be mounted with the spring member 228. On a part of an each periphery of the one spring-support parts 106, there is formed a spring-member guide part 108, in a curved surface shape, that guides the spring member 228.

On the second rear surface 110 of the second housing 102, there are formed the contact insertion ports 112 that are inserted with the second contacts 60.

On an outer circumference side of the second rear surface 110, namely, on the second upper surface 114 side, the second bottom surface 116 side, the one second-side-surface 118 side, and the another second-side-surface 120 side, a protruding flange portion 154 is formed. This flange portion 154 is a part to be abutted with or brought close to the slide member 162 described later, in fitting with the first connector member 12.

On the second upper surface 114 of the second housing 102, there is formed a guide groove 146 that is cut from the first front surface 22 side, at a center portion. This guide groove 146 is a part that is to cause a change in the movable piece 180 formed in the slide member 162 in accordance with movement of the slide member 162, and is a part into which the movable piece 180 is to be fitted. This guide groove 146 has the pressing part 44 that is contacted with a tip part of the movable piece 180 and presses the movable piece 180, and a fitting part 150 into which the pressed movable piece 180 is fitted along with the movement of the slide member 162.

The second upper surface 114 is formed with an upper-surface engagement projection 156 that is engaged with the slide member 162 and guides the movement of the slide member 162 on each of the one second-side-surface 118 side and the another second-side-surface 120 side.

On the second bottom surface 116 of the second housing 102, there is formed a bottom-surface engagement projection 160 that is engaged with the slide member 162 and guides the movement of the slide member 162, at a substantially center portion.

On each of the one second-side-surface 118 and the another second-side-surface 120, a guide groove 152 is formed along the moving direction of the slide member 162, from the second front surface 104 through the second rear surface 110. This guide groove 152 is a part that is to guide a guide projection 200 formed in the slide member 162 described later.

On each of the one second-side-surface 118 and the another second-side-surface 120, there is formed a side-surface engagement projection 158 that is engaged with the slide member 162 and guides the movement of the slide member 162. Note that, the upper-surface engagement projection 156, the bottom-surface engagement projection 160, and each of the side-surface engagement projections 158 may collectively be referred to as each of the engagement projections 156, 158, and 160.

The contact container 140 inside the second housing 102 is formed with the concave portion 142 that is formed to be partially recessed. The concave portion 142 is inserted with the convex portion 78 formed on the upper surface portion 66 of the second contact 60, guides the insertion of the second contact 60, and can prevent the second contact 60 from being inserted in a different direction. The contact container 140 is formed with the claw-shaped lance 144 into which the fitting port 92 formed on the second contact 60 enters (see FIGS. 8B and 8D).

The concave portion 142 of the contact container 140 is formed on the second bottom surface 116 side of the second housing 102, and the lance 144 is formed on the second upper surface 114 side. Therefore, the second contact 60 is to be inserted into the contact container 140 of the second housing 102 with the upper surface portion 66 side directed to the second bottom surface 116 side, and the bottom surface portion 68 side directed in the second upper surface 114 side, namely, in a state reversed from that illustrated in FIGS. 6A to 6D.

Next, the slide member 162 is described with reference to FIGS. 2, 9A to 10E, and 12. The slide member 162 is a cylindrical body disposed with the insertion part 122 of the second housing 102, and surrounded by: a front surface 164 formed with a second opening 166 in which the first housing 20 of the first connector member 12 is inserted; a rear surface 168 formed with a mounting port 170 in which the second housing 102 is inserted and mounted; and an upper surface 172, a bottom surface 174, a one side-surface 176, and an another side-surface 178. The slide member 162 is integrally formed by a resin material. Inside the slide member 162 is configured as a hollow container 208 that is provided with the second housing 102.

The front surface 164 of the slide member 162 is formed with the second opening 166, in which the insertion part 122 of the second housing 102 is to be disposed, and the first housing 20 of the first connector member 12 is to be inserted.

The upper surface 172 side of the second opening 166 is provided with the movable piece 180, and formed with a movable groove 202 in which the movable piece 180 is repeatedly moved. The front surface 164 side of the movable piece 180 is provided with the pressed part 182 that is pressed by the pressing part 44 of the concave portion 40 of the locking projection 38 formed on the first housing 20 of the first connector member 12.

On the upper surface 172 side of the second opening 166, there is provided an upper-surface guide groove 210 that is inserted with the upper-surface guide part 50 formed on the first housing 20, on the one side-surface 176 side and the another side-surface 178 side. This upper-surface guide groove 210 is formed by a gap between the second opening 166 and the movable piece 180, and the upper-surface guide part 50 of the first housing 20 is to be inserted between the second opening 166 and the movable piece 180.

On the bottom surface 174 side of the second opening 166 of the slide member 162, there are formed bottom-surface guide grooves 216 that each are inserted with the bottom-surface guide part 56 formed on the first housing 20. Each of these bottom-surface guide grooves 216 is slantly formed corresponding to the bottom-surface guide part 56.

On the one side-surface 176 side of the second opening 166 of the slide member 162, there is formed a one side-surface guide groove 212 inserted with the another side-surface guide part 54 that is formed on the first housing 20. This one side-surface guide groove 212 is slantly formed corresponding to the another side-surface guide part 54.

On the another side-surface 178 side of the second opening 166 of the slide member 162, there is formed an another side-surface guide groove 214 inserted with the one side-surface guide part 52 that is formed on the first housing 20. This another side-surface guide groove 214 is formed orthogonal to an insertion direction of the first housing 20, corresponding to the one side-surface guide part 52. Note that, the upper-surface guide groove 210, the bottom-surface guide groove 216, the one side-surface guide groove 212, and the another side-surface guide groove 214 may collectively be referred to as each of the guide grooves 210, 212, 214, and 216.

The front surface 164 side of the slide member 162 is formed to have a predetermined thickness, and each of the guide grooves 210, 212, 214, and 216 is also formed over a predetermined length. By performing the insertion with a shape or a direction of each of the guide parts 50, 52, 54, and 56 of the first housing 20 corresponding to each of the guide grooves 210, 212, 214, and 216 of the slide member 162, the first connector member 12 can be inserted in a correct direction.

Inside the front surface 164 of the slide member 162, a pair of rod-shaped another spring-support parts 196 each are formed to protrude toward the one side-surface 176 side and the another side-surface 178 side, on the upper surface 172 side. Each of these another spring-support parts 196 is a part to be mounted with the spring member 228, and is formed at a position corresponding to each of the one spring-support parts 106 formed in the second housing 102.

On the one side-surface 176 side and the another side-surface 178 side of the front surface 164 of the slide member 162, there are formed grooves that form the engagement grooves 218 and 220 that respectively guide the side-surface engagement projection 158 and the bottom-surface engagement projection 160 among the engagement projections 156, 158, and 160 formed on the second housing 102 described later.

The rear surface 168 of the slide member 162 is formed with the mounting port 170 that is largely opened so as to be inserted with the second housing 102.

The upper surface 172 side of the rear surface 168 is formed with a cut portion 204 so as to be opened in a chevron shape with the rear surface 168 side widened, and to be provided with the movable piece 180. On the rear surface 168 side of the movable piece 180, a fitting projection part 186 is formed.

On each of the bottom surface 174 side, the one side-surface 176 side, and the another side-surface 178 side, of the rear surface 168, a slanted inclined portion 206 is formed, which is a part to be inserted with each of the bottom-surface engagement projection 160 and the side-surface engagement projection 158 that are formed on the second bottom surface 116 of the second housing 102.

On each of the one side-surface 176 side and the another side-surface 178 side of the rear surface 168, there is formed a projection that forms the guide projection 200 that is guided by the guide groove 152 formed on each of the one second-side-surface 118 and the another second-side-surface 120 of the second housing 102.

The upper surface 172 of the slide member 162 is provided with the movable piece 180 that performs engagement with and disengagement from the fitted first connector member 12.

The movable piece 180 is a plate-like body provided along the insertion direction of the first housing 20. A part of a substantially center portion of both sides of this plate-like body is connected to the upper surface 172 as a shaft part 184. Then, the movable piece 180 is rotatably movable about this shaft part 184 as an axis.

The front surface 164 side of the movable piece 180 is formed with the pressed part 182 that is pressed by the pressing part 44 of the locking projection 38 formed on the first housing 20. This pressed part 182 is formed to be partially narrowed to be fitted into the concave portion 40 of the locking projection 38 of the first housing 20, and is to be pressed by the pressing part 44 on the depth side of the concave portion 40 of the locking projection 38 of the first housing 20.

Both ends of the pressed part 182 on the front surface 164 side of the movable piece 180 are slantly formed. Additionally, on the front surface 164 side of the movable piece 180, a hook-shaped locking part 192 is formed on the bottom surface 174 side. This locking part 192 has a slanted shape to be engaged with the slanted locking surface 46 of the locking projection 38 formed on the first housing 20, suppressing disengagement.

The rear surface 168 side of the movable piece 180 is formed with the fitting projection part 186 that is fitted into the fitting part 150 of the guide groove 146 of the second housing 102. This fitting projection part 186 has a tapered portion 188 in which the upper surface 172 side is slanted, and is to be pressed by the pressing projection part 148 formed to the guide groove 146, and then guided by the fitting part 150.

The upper surface 172 side of the movable piece 180 is formed with an operation part 190 for disengagement of the movable piece 180 engaged with the locking projection 38 of the first housing 20. Pressing this operation part 190 downward causes rotational movement of the movable piece 180 about the shaft part 184 as the axis, and movement of the locking part 192 engaged to the locking surface 46 of the locking projection 38, resulting in disengagement.

The upper surface 172 side of the movable piece 180 is covered by the covering part 194. This covering part 194 is for protecting the movable piece 180 and securing strength of the upper surface 172.

Figure 13A:
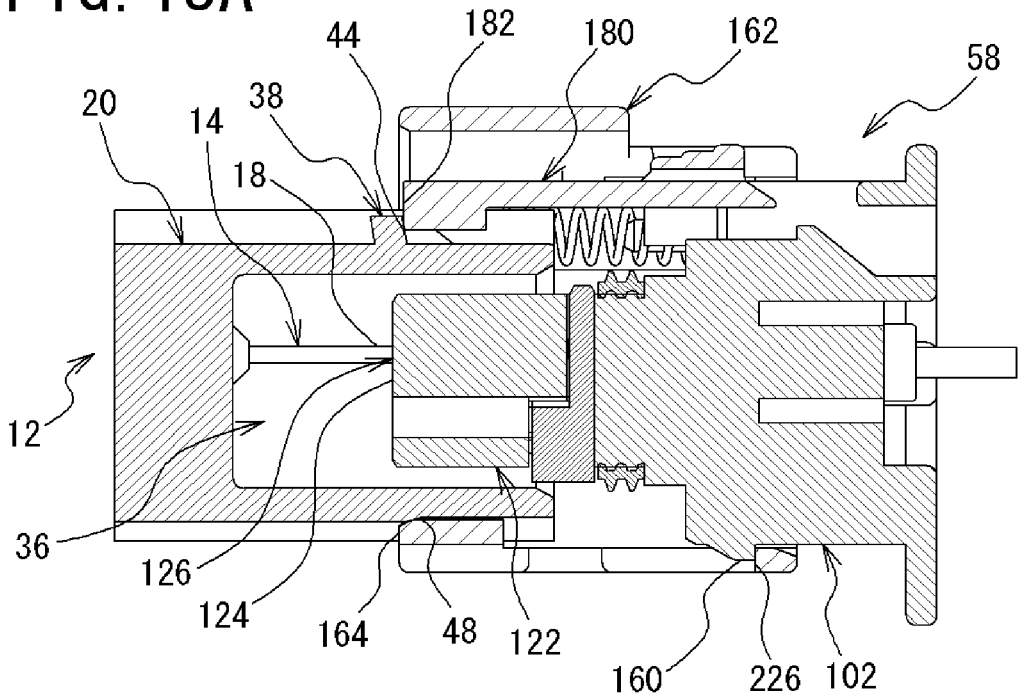
FIG. 13A is a cross-sectional view following FIG. 12 and explaining fitting of the first connector member and the second connector member.
Figure 13B:
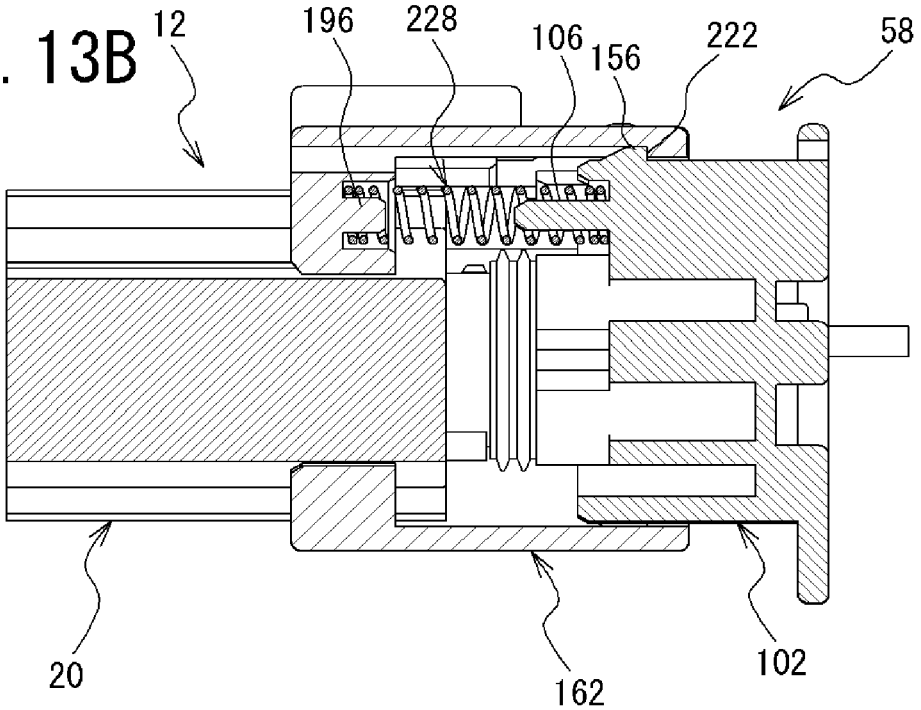
FIG. 13B is a cross-sectional view of XIIIB-XIIIB line in FIG. 1A, corresponding to FIG. 13A.

Inside the upper surface 172 is formed with an upper-surface engagement part 222 that is engaged with the upper-surface engagement projection 156 (see FIG. 13B).

The bottom surface 174 of the slide member 162 is engaged with the bottom-surface engagement projection 160 formed on the second bottom surface 116 of the second housing 102, and is formed with a bottom-surface engagement groove 220 that guides movement of the second housing 102.

This bottom-surface engagement groove 220 is formed at a position corresponding to the inclined portion 206 formed on the bottom surface 174 side of the slide member 162. Between the bottom-surface engagement groove 220 and the inclined portion 206 is configured as a bottom surface engagement part 226 that is engaged with the bottom-surface engagement projection 160, which is a part to be engaged with the bottom-surface engagement projection 160 of the second housing 102.

The bottom surface 174 is formed with a retainer insertion hole 198 into which the retainer 230 is inserted. This retainer insertion hole 198 is formed to be connected with the bottom-surface engagement groove 220, and is also a part where the bottom-surface engagement projection 160 of the second housing 102 is to be moved.

On each of the one side-surface 176 and the another side-surface 178 of the slide member 162, there is formed a side-surface engagement groove 218 that is engaged with the side-surface engagement projection 158 formed on each of the one second-side-surface 118 and the another second-side-surface 120 of the second housing 102, and guides the movement of the second housing 102.

This bottom-surface engagement groove 220 is formed at a position corresponding to the inclined portion 206 formed on each of the one side-surface 176 side and the another side-surface 178 side of the slide member 162. Between the side-surface engagement groove 218 and the inclined portion 206 is configured as a side-surface engagement part 224 that is engaged with the side-surface engagement projection 158, which is a part to be engaged with each the side-surface engagement projection 158 of the second housing 102. Note that, the bottom-surface engagement groove 220 and each the side-surface engagement groove 218 may collectively be referred to as each of the engagement grooves 218 and 220. Moreover, the upper-surface engagement part 222, the side-surface engagement part 224, and the bottom surface engagement part 226 may collectively be referred to as each of the engagement parts 222, 224, and 226.

Each inside of the one side-surface 176 and the another side-surface 178 is formed with the guide projection 200 that protrudes in an inserting direction of the second housing 102.

Figure 11A:
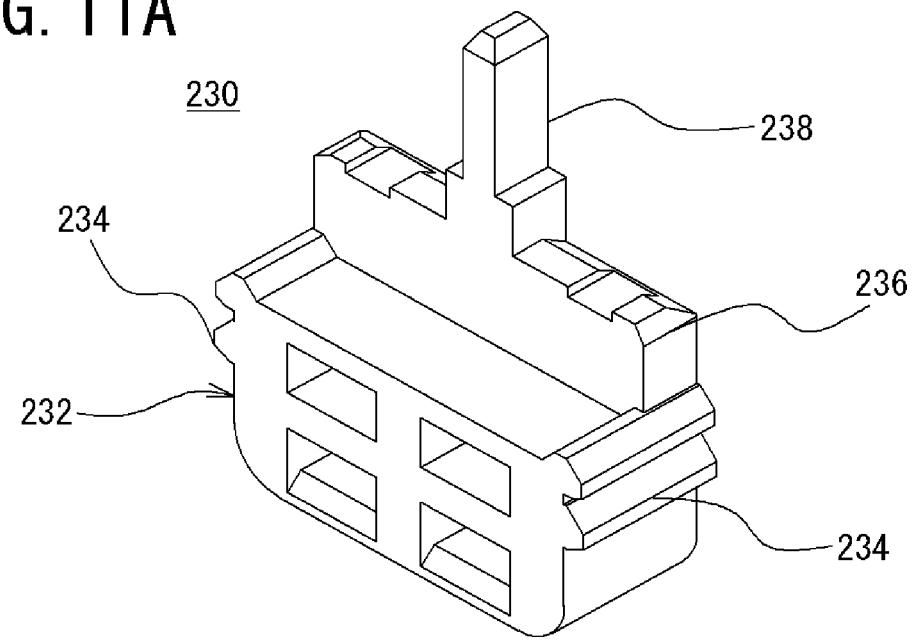
FIG. 11A is a perspective view of a retainer as viewed from one side.
Figure 11B:
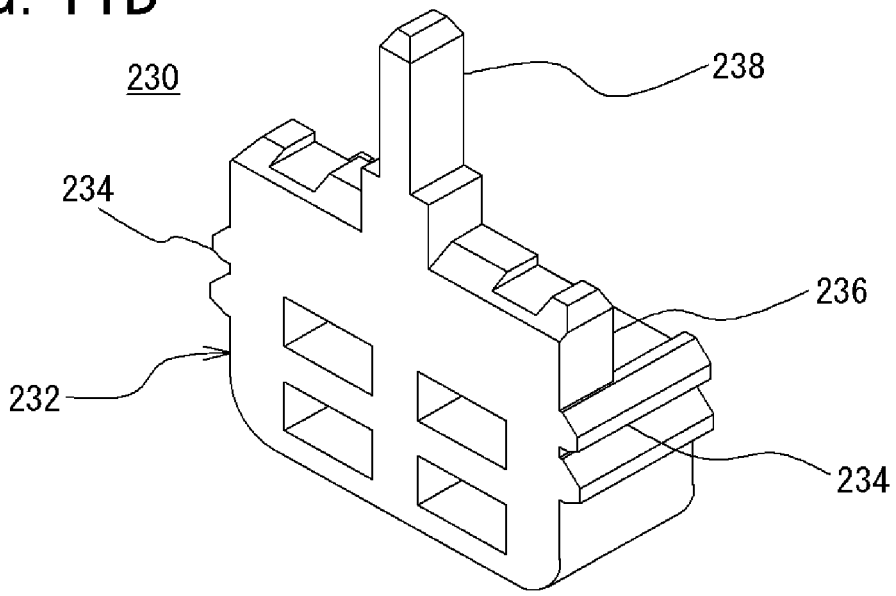
FIG. 11B is a perspective view as viewed from another side.

Next, the retainer 230 is described with reference to FIGS. 11A to 12. The retainer 230 is for positioning and fixing the second contact 60 contained in the second housing 102, and is configured by a rectangular parallelepiped retainer main body 232 that has a predetermined thickness; the fixing projection 236 formed to protrude on a side to be inserted into the second housing 102, of the retainer main body 232; and the supporting part 238 further extended from a substantially center portion of the fixing projection 236. The retainer 230 is inserted and mounted in the retainer mounting part 134 of the second housing 102, for positioning and fixing the second contact 60 in the contact container 140.

On each sides of the retainer main body 232, there is formed an attaching part 234 in a wedge shape, which is attached to the second housing 102.

The fixing projection 236 is fitted with the fixing part 88 of the second contact 60 that is in a state being in contained in the contact container 140 of the second housing 102, so that the second contact 60 can be positioned and fixed in the contact container 140.

The supporting part 238 is a columnar body further extended from the fixing projection 236. Inserting the supporting part 238 into the second housing 102 causes the two second contacts 60 to be separated and prevented from coming into contact with each other. Additionally, making the supporting part 238 projecting from the retainer-projecting port 130 of the second housing 102 allows the retainer 230 to be supported and prevented from moving.

The spring member 228 as the elastic member is a coiled spring body having a predetermined length, and provided between each of the one spring-support parts 106 of the second housing 102 and each of the another spring-support parts 196 of the slide member 162.

As illustrated in FIGS. 2 and 12, the seal member 240 is annularly formed by a resin material, such as a rubber, having an elastic force, and is to be attached to an outer circumference on the second front surface side of the insertion part of the second housing 102. When the first connector member 12 is fitted with the second connector member 58, the seal member 240 adheres to inside the space part 36 of the first housing 20, providing waterproofness.

Next, assembly of the second connector member 58 is described with reference mainly to FIGS. 2, 4A to 5E, and 12. In assembling the second connector member 58, the slide member 162 is firstly attached to the second housing 102. In this attachment, from the mounting port 170 of the rear surface 168 of the slide member 162, the second front surface 104 side of the second housing 102 is firstly inserted. Here, the seal member 240 is mounted to the second front surface 104 side of the insertion part 122 of the second housing 102, and the spring member 228 is attached between the one spring-support part 106 formed on the second front surface 104 of the second housing 102, and the another spring-support part 196 formed inside the front surface 164 of the slide member 162.

When the insertion part 122 of the second housing 102 is firstly inserted from the mounting port 170 of the slide member 162, the side-surface engagement projection 158 and the bottom-surface engagement projection 160 of the second housing 102 are abutted to the rear surface 168 side of the slide member 162. Here, each of the side-surface engagement projection 158 and the bottom-surface engagement projection 160 is disposed at a position corresponding to the inclined portion 206 formed on the rear surface 168 of the slide member 162. As the second housing 102 is further inserted into the slide member 162, the side-surface engagement projection 158 and the bottom-surface engagement projection 160 of the second housing 102 is moved along and over the inclined portion 206, thereby to be fitted into each of the engagement grooves 218 and 220 of the slide member 162.

In response to the insertion of the second housing 102 and the slide member 162, the spring member 228 is compressed and disposed while having an elastic force, and the second housing 102 and the slide member 162 are pressed in a separating direction. Here, each of the engagement projections 156, 158, and 160 of the second housing 102 are engaged with each of the engagement part 222, 224, and 226 on the rear surface 168 side of the slide member 162, so that the second housing 102 and the slide member 162 are temporarily fixed.

The insertion part 122 of the second housing 102 is inserted into the second opening 166 of the slide member 162, and disposed at a position slightly protruding from the front surface 164. Here, between the second opening 166 of the slide member 162 and the insertion part 122 of the second housing 102, a gap is formed so as to surround the insertion part 122, and the first housing 20 of the first connector member 12 is inserted into this gap.

Then, from the contact insertion port 112 formed on the second rear surface 110 of the second housing 102, the insertion port 64 of the second contact 60 mounted with the wire 98 is firstly inserted and contained in the contact container 140. Here, the second contact 60 is inserted with the upper surface portion 66 facing downward, and the bottom surface portion 68 facing upward. By inserting the convex portion 78 formed on the upper surface portion 66 of the second contact 60 through the concave portion 142 formed in the contact container 140, the second contact 60 can be inserted in a correct direction.

When the second contact 60 is contained in the contact container 140, the lance 144 formed in the contact container 140 is fitted into the fitting port 92 formed on the bottom surface portion 68 of the second contact 60.

Then, the retainer 230 is inserted through the retainer insertion hole 198 of the bottom surface 174 of the slide member 162, and inserted into the retainer mounting part 134 formed in the bottom part 132 of the insertion part 122 of the second housing 102 to be mounted to the insertion part 122. Here, the fixing part 88 of the second contact 60 is fitted with the fixing projection 236 of the retainer 230, the second contact 60 is positioned and fixed, the attaching part 234 of the retainer 230 is attached in the insertion part 122, and the supporting part 238 projects from the retainer-projecting port 130 of the upper part 128 of the insertion part 122, so that the attachment is performed while the movement of the retainer 230 is restrained.

Thus, the assembly of the second connector member 58 is completed. Additionally, the second contact 60 may be mounted before the second housing 102 is attached to the slide member 162.

Next, the fitting of the first connector member 12 and the second connector member 58 is described with reference mainly to FIGS. 1, and 12 to 16B. In the fitting of the first connector member 12 and the second connector member 58, from the arrangement illustrated in FIGS. 1A, 1B, and 12, the first front surface 22 side of the first housing 20 of the first connector member 12 is inserted into the front surface 164 side of the slide member 162 of the second connector member 58.

Here, each of the guide parts 50, 52, 54, and 56 formed on the outer circumference of the first housing 20 is inserted into each of the guide grooves 210, 212, 214, and 216 formed in the second opening 166 of the slide member 162, and the insertion part 122 of the second housing 102 is inserted into the first opening 24 of the first housing 20.

Then, when the first connector member 12 is inserted, the pressing part 44 of the locking projection 38 formed on the first upper surface 28 of the first housing 20 is abutted with the pressed part 182 of the movable piece 180 of the slide member 162, as illustrated in FIGS. 13A and 13B. The pressed part 182 of the movable piece 180 enters into the concave portion 40 from between the pair of protrusions 42 of the locking projection 38, and is abutted to the pressing part 44 on the depth side of the concave portion 40. Moreover, the first front surface 22 side of the pressing projection 48 formed on the outer circumference of the first housing 20 is abutted to the front surface 164 side of the slide member 162.

Then, as the first connector member 12 is further inserted, the pressing part 44 of the first housing 20 presses the pressed part 182 of the slide member 162, and each the pressing projection 48 of the first housing 20 presses the front surface 164 of the slide member 162, causing the slide member 162 to move toward the second housing 102 along with the first housing 20. Here, the side-surface engagement projection 158 and the bottom-surface engagement projection 160 formed on the second housing 102 are respectively moved along the engagement grooves 218 and 220 formed in the slide member 162, and each of the guide projections 200 formed in the slide member 162 are moved while being guided by the guide groove 152 formed on the second housing 102.

Insertion of the first connector member 12 into the second connector member 58 causes compression of the spring member 228 that is provided between the second housing 102 and the slide member 162, in accordance with the movement of the first housing 20.

Moreover, the first contact part 18 of the first contact 14 protruding to the space part 36 of the first housing 20 of the first connector member 12 is inserted from the insertion opening 126 formed on the front part 124 of the insertion part 122 of the second housing 102.

Figure 14A:
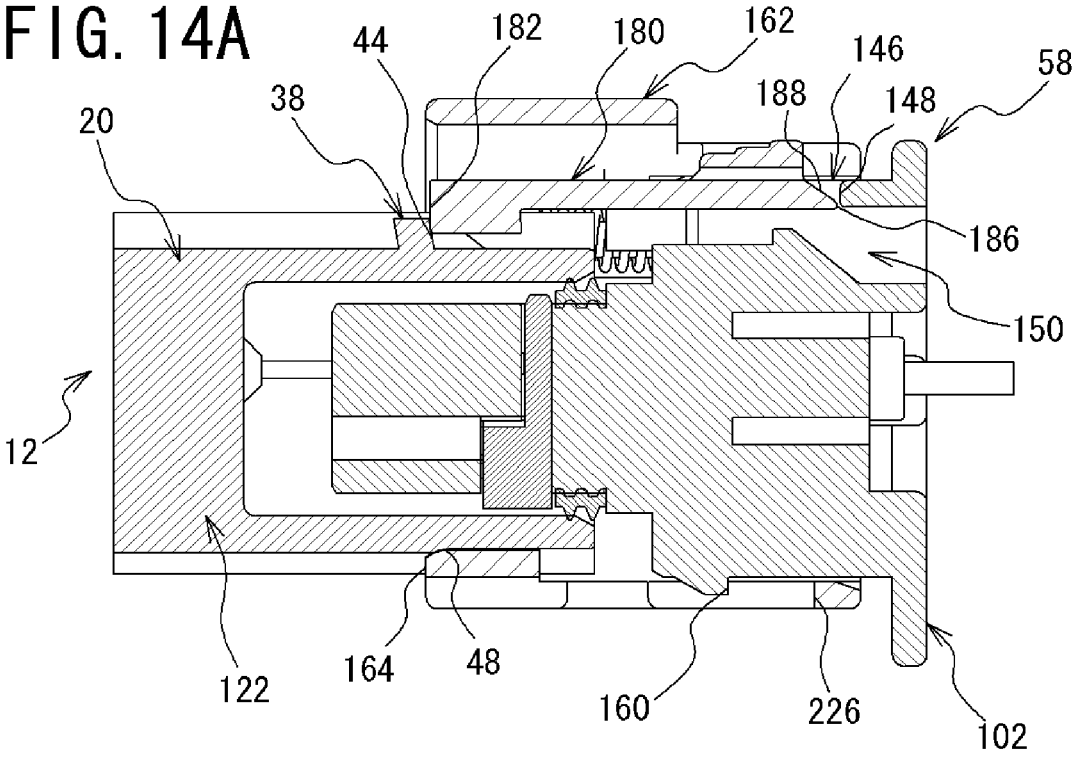
FIG. 14A is a cross-sectional view following FIG. 13A and explaining the fitting of the first connector member and the second connector member.
Figure 14B:
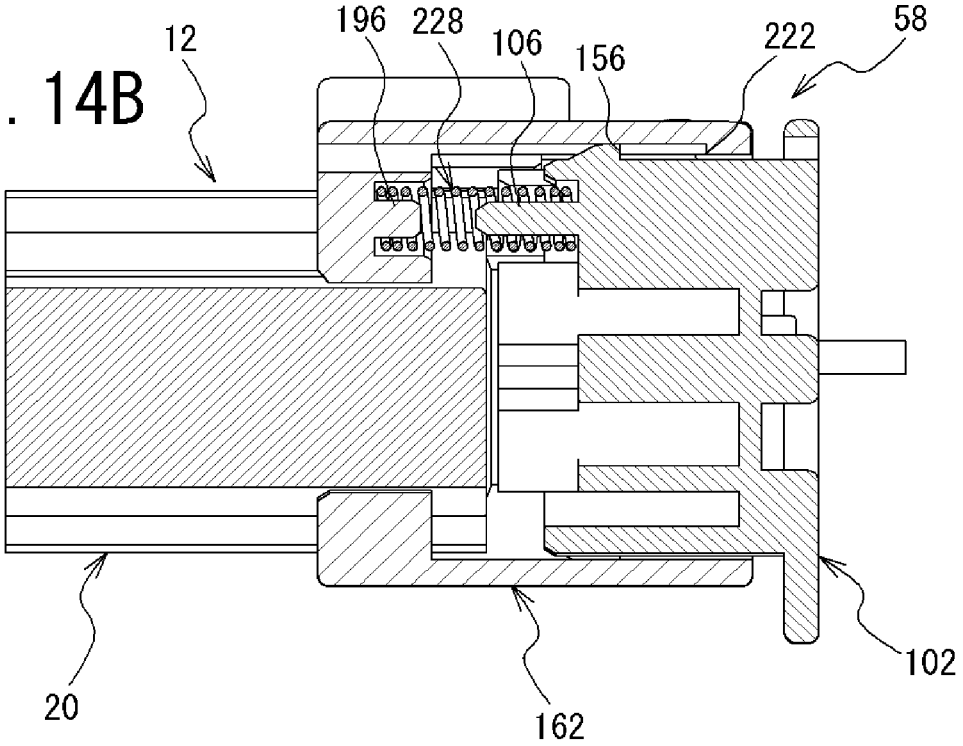
FIG. 14B is a cross-sectional view following FIG. 13B.

As the first connector member 12 is further inserted from this state, as illustrated in FIGS. 14A and 14B, the fitting projection part 186 on the rear surface 168 side of the movable piece 180 of the slide member 162 is abutted to a pressing projection part 148 of the guide groove 146 of the second housing 102.

Figure 15A:
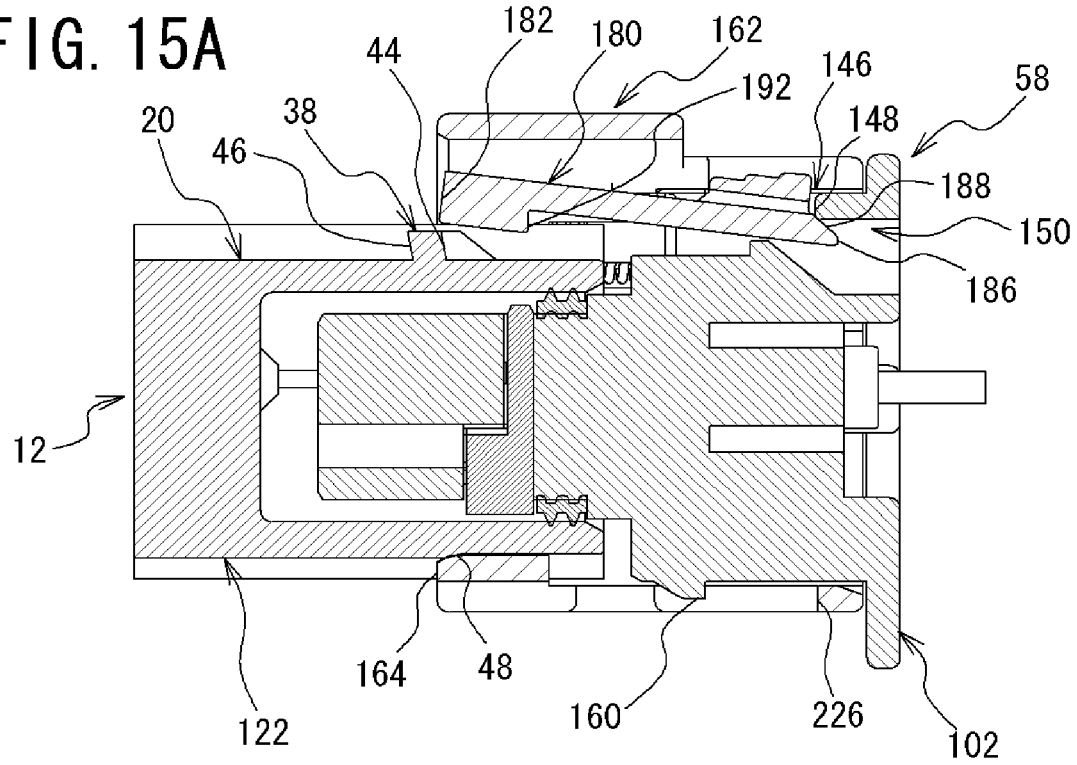
FIG. 15A is a cross-sectional view following FIG. 14A and explaining the fitting of the first connector member and the second connector member.
Figure 15B:
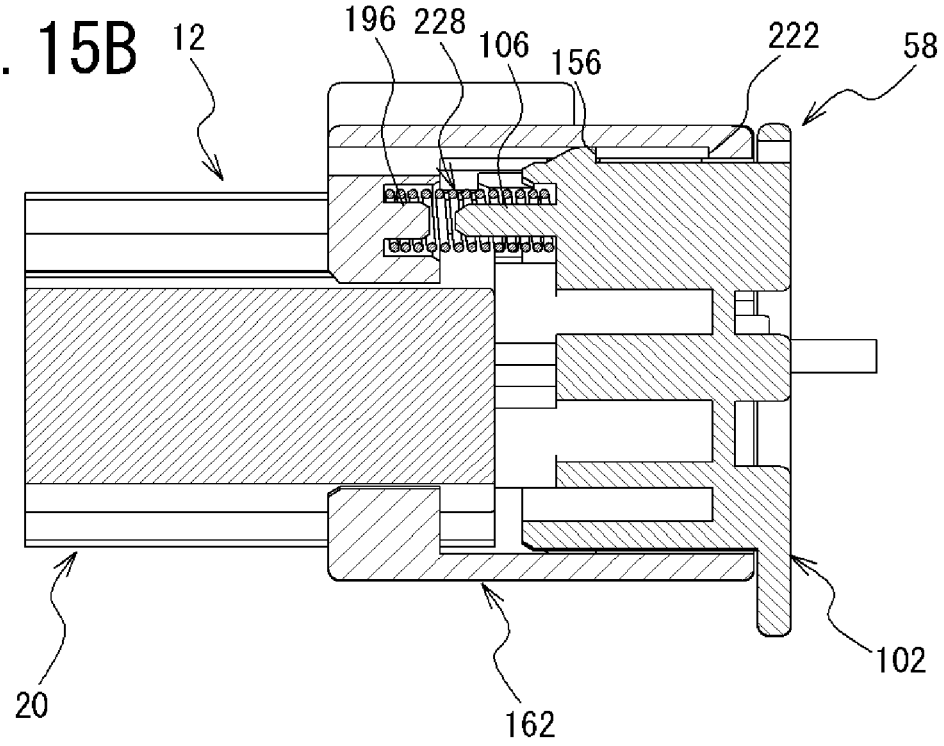
FIG. 15B is a cross-sectional view following FIG. 14B.

Then, as the first connector member 12 is further inserted while the fitting projection part 186 of the movable piece 180 is abutted with the pressing projection part 148 of the guide groove 146, as illustrated in FIGS. 15A and 15B, the fitting projection part 186 pressed by the pressing projection part 148 is moved toward the fitting part 150 side along the slope of a tapered portion 188 formed on the fitting projection part 186.

Here, the movable piece 180 is rotated and moved about the shaft part 184 of the upper surface 172 as the axis. When the first connector member 12 is further inserted from this state, the fitting projection part 186 of the movable piece 180 further enters into the fitting part 150 of the guide groove 146, and the pressed part 182 on the opposite side to the fitting projection part 186 of the movable piece 180 is rotatably moved in the opposite direction to the fitting projection part 186, namely, in the separating direction from the first housing 20. Thus, the pressed part 182 of the movable piece 180 is separated from the pressing part 44 of the first housing 20.

Figure 16A:
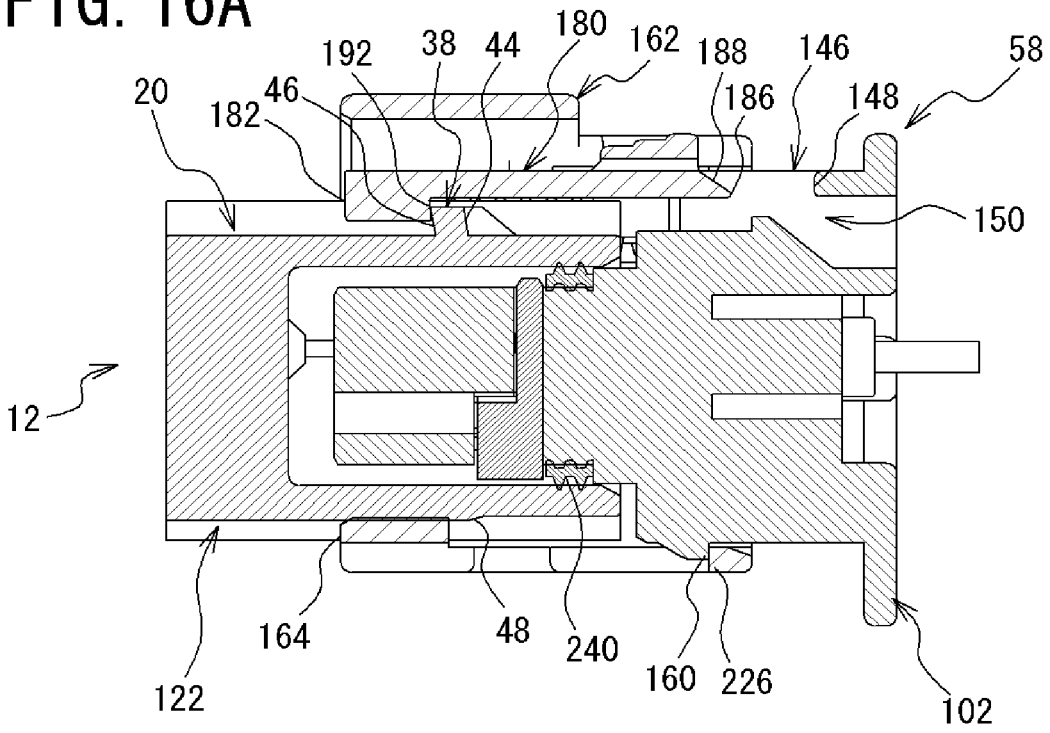
FIG. 16A is a cross-sectional view following FIG. 15A and explaining the fitting of the first connector member and the second connector member.
Figure 16B:
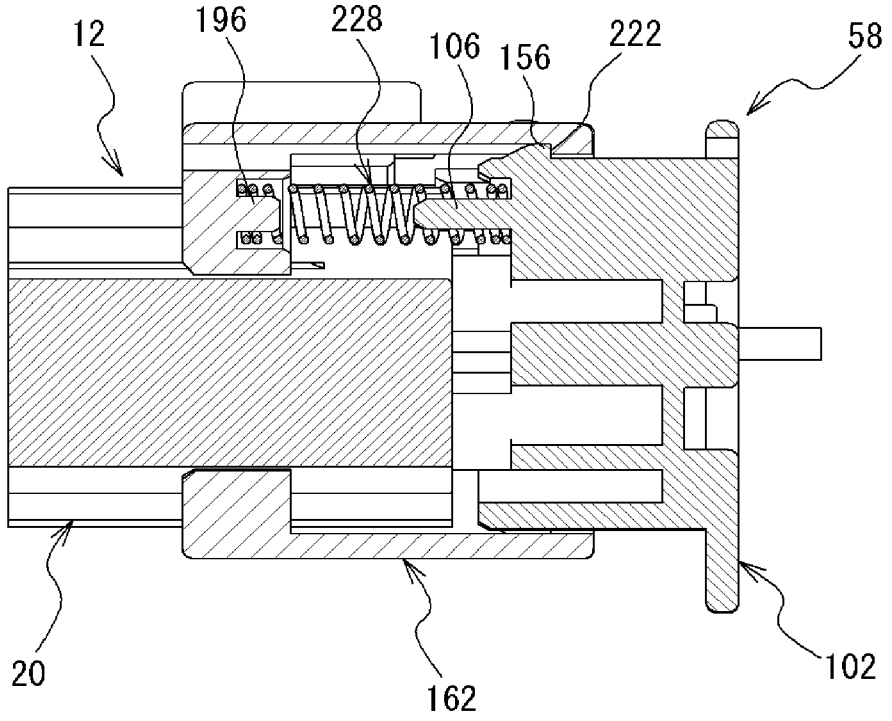
FIG. 16B is a cross-sectional view following FIG. 15B.

Then, when the pressed part 182 of the movable piece 180 is separated from the pressing part 44 of the locking projection 38, as illustrated in FIGS. 16A and 16B, the slide member 162 is moved in the opposite direction to the second housing 102 by the elastic force of the spring member 228. Here, regarding the pressing projection 48, of the first housing 20, that has been pressing the front surface 164 of the slide member 162, since the pressure of the movable piece 180 to the pressed part 182 is released and a slight gap is created, the front surface 164 of the slide member 162 is also separated from the pressing projection 48, allowing the slide member 162 to move. Since the pressing side of the pressing projection 48 and the front surface 164 of the slide member 162 are slanted, the slide member 162 can be easily separated. Additionally, since the protrusions 42 of the locking projection 38 are slantly formed, the movable piece 180 can smoothly move over the locking projection 38.

Then, the slide member 162 moved by the elastic force of the spring member 228 is rotated in the opposite direction about the shaft part 184 as the axis, at a position where the movable piece 180 has moved over the locking projection 38, to return to the original position, and is disposed on the first upper surface 28 of the first housing 20. Thus, the locking part 192 of the movable piece 180 is abutted and engaged with the locking surface 46 of the locking projection 38.

The first contact part 18 of the first contact 14 of the first connector member 12 is contacted and conducted with the second contact part 76 of the second contact 60 contained in the contact container 140 in the insertion part 122 of the second housing 102. In this contact, by further inserting the first contact part 18 of the first contact 14 inserted from the insertion opening 126 formed on the front part 124 of the insertion part 122 of the second housing 102, the first contact part 18 is inserted inside the second contact 60 from the insertion port 64 of the second contact 60 contained in the contact container 140 coupled to the insertion opening 126, and is contacted with the second contact part 76 formed on the contact piece 74 provided inside the second contact body 62. Here, elastic deformation of the contact piece 74 causes contact between the first contact part 18 and the second contact part 76 with a high contact pressure.

Moreover, inserting the insertion part 122 of the second housing 102 into the space part 36 of the first housing 20 causes the seal member 240 mounted to the insertion part 122 to adhere to the inner circumference of the space part 36. Thus, the fitting of the first connector member 12 and the second connector member 58 is completed.

Figure 17:
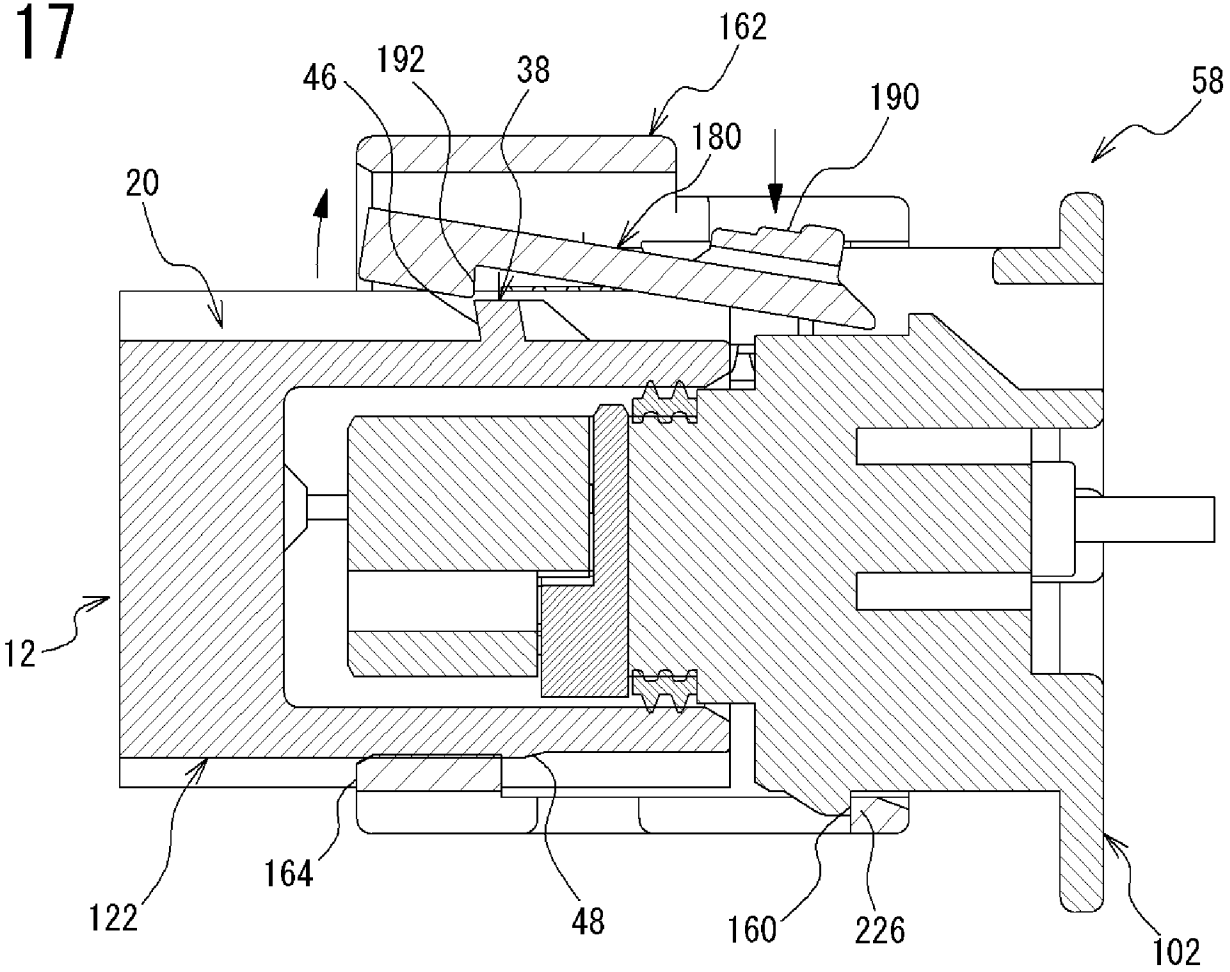
FIG. 17 is a cross-sectional view corresponding to FIG. 12 and explaining detachment of the first connector member and the second connector member.

For detachment of the first connector member 12 and the second connector member 58, as illustrated in FIG. 17, pressing the operation part 190 of the movable piece 180 downward causes rotation of the movable piece 180 about the shaft part 184 as the axis, and the upward movement of the locking part 192 engaged to the locking surface 46 of the locking projection 38 of the first housing 20, resulting in disengagement. Then, pulling the disengaged first connector member 12 from the second connector member 58 enables detachment of the first connector member 12 and the second connector member 58.

What is claimed is:

1. A connector member including a slide member having a locking part to be engaged with a locking projection provided on an outer circumference of a counterpart connector member, and a housing provided inside the slide member, the connector member comprising:

at least one elastic member provided between the housing and the slide member;

a movable piece provided to the slide member, the movable piece being connected by a shaft part and rotatable about the shaft part as an axis, in a direction orthogonal to a moving direction of the slide member; and a pressed part included in the movable piece, the pressed part being configured to be pressed toward fitting-direction side of the locking projection, wherein the slide member is capable of repeatedly moving in a fitting direction with respect to the housing, the movable piece has the locking part that is engaged to a side opposite to the fitting-direction side of the locking projection, and when the connector member is fitted with the counterpart connector member, movement of the counterpart connector member in the fitting direction causes the pressed part of the movable piece to be pressed by the locking projection, so that the slide member is moved to the fitting direction while compressing the elastic member, and the connector member and the counterpart connector member are put in a fitting condition, and after that, rotation of the movable piece about the shaft part as the axis causes the pressed part to separate from the locking projection, and an elastic force of the elastic member causes movement of the slide member in a direction opposite to the moving direction, and engagement of the locking part of the movable piece to the locking projection.

2. A connector in which a first connector member having a first housing provided with a locking projection on an outer circumference is fitted with a second connector member having a slide member that has a locking part to be engaged with the locking projection, and a second housing provided inside the slide member, the connector comprising:

at least one elastic member provided between the second housing and the slide member;

a movable piece provided to the slide member, the movable piece being connected by a shaft part and rotatable about the shaft part as an axis, in a direction orthogonal to a moving direction of the slide member; and a pressed part included in the movable piece, the pressed part being configured to be pressed toward fitting-direction side of the locking projection, wherein the slide member is capable of repeatedly moving in a fitting direction with respect to the second housing, the movable piece has the locking part that is engaged to a side opposite to the fitting-direction side of the locking projection, and when the first connector member is fitted with the second connector member, movement of the first housing in the fitting direction causes the pressed part of the movable piece to be pressed by the locking projection of the first housing, so that the slide member is moved to the fitting direction while compressing the elastic member, and the first connector member and the second connector member are put in a fitting condition, and after that, rotation of the movable piece about the shaft part as the axis causes the pressed part to separate from the locking projection, and an elastic force of the elastic member causes movement of the slide member in a direction opposite to the moving direction, and engagement of the locking part of the movable piece to the locking projection.

3. The connector according to claim 2, wherein there is provided a pressing projection that presses an opposite side to the pressed part across the shaft part of the movable piece, of the second housing, that is fitted with the first housing, to cause rotation about the shaft part as an axis, and the movable piece of the moved slide member is rotated by pressing with the pressing projection.

4. The connector according to claim 3, wherein, on a side of the second housing opposite to a side to be fitted with the first housing, there is formed a fitting part into which the movable piece pressed by the pressing projection is fitted.

5. The connector according to claim 2, wherein an operation part is formed on a side opposite to the pressed part across the shaft part of the movable piece, and rotation of the movable piece by pressing the operation part causes disengagement between the locking projection of the second housing and a locking part of the movable piece.

6. The connector according to claim 2, wherein the slide member is formed into a cylindrical shape to surround the second housing, the movable piece is provided on a surface that surrounds the second housing of the slide member, and a covering part that covers the movable piece is provided on the surface of the slide member provided with the movable piece.

* * * * *